US005929831A

United States Patent [19]

Aratani et al.

[11] Patent Number: 5,929,831

[45] **Date of Patent: *Jul. 27, 1999**

[54] DISPLAY CONTROL APPARATUS AND METHOD

[75] Inventors: Shuntaro Aratani, Machida; Yoshikazu Shibamiya, Tokyo, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/063,436

[22] Filed: May 18, 1993

[30] Foreign Application Priority Data

May 19, 1992 [JP] Japan ..... 4-126144
May 19, 1992 [JP] Japan ..... 4-126145

[51] Int. Cl.[6] ..... G09G 3/36

[52] U.S. Cl. ..... 345/97; 345/87; 345/94; 345/99

[58] Field of Search ..... 345/53, 87, 94, 345/95, 97, 99, 101, 102, 98, 201

[56] References Cited

U.S. PATENT DOCUMENTS 5,091,723 2/1992 Kanno et al. ..... 345/97
5,298,913 3/1994 Numao et al. ..... 345/97
5,357,267 10/1994 Inoue ..... 345/98

FOREIGN PATENT DOCUMENTS 0318050 5/1989 European Pat. Off. ..... G09G 3/36
0464620 1/1992 European Pat. Off. ..... G09G 3/36

*Primary Examiner*—Richard A. Hjerpe
*Assistant Examiner*—Kent Chang
*Attorney, Agent, or Firm*—Morgan & Finnegan, L.L.P.

[57] ABSTRACT

A display control apparatus is combined to a display apparatus which is constructed by a display element having a memory performance. The display control apparatus comprises a memory unit to store display data to be displayed on the display apparatus, a detection unit to detect the area in which the data has been updated in the memory unit, and a control unit for performing a scan control of the display apparatus in a manner such that the scanning area on the display means corresponding to the area detected by the detection unit is preferentially scanned than the scanning areas on the display apparatus other than the area detected by the detection unit.

31 Claims, 20 Drawing Sheets

FIG. 8

| ONE LINE SCANNING TIME | PANEL STATUS Pst | | INTERLACE |
|---|---|---|---|
| 50 ~ 70 μs | 1 | → | 3 FIELD INTERLACE |
| 75 ~ 100 μs | 2 | → | 4 FIELD INTERLACE |
| 100 ~ 125 μs | 3 | → | 5 FIELD INTERLACE |
| 125 ~ 150 μs | 4 | → | 6 FIELD INTERLACE |

FIG. 12

| PANEL SPEED | Pst |
|---|---|
| SCANNING SPEED 50~75μs<br>FRAME FREQUENCY 20~14Hz | 0 |
| SCANNING SPEED 70~90μs<br>FRAME FREQUENCY 14~11Hz | 1 |
| SCANNING SPEED 90~120μs<br>FRAME FREQUENCY 11~8Hz | 2 |
| SCANNING SPEED 120~150μs<br>FRAME FREQUENCY 8~6.5Hz | 3 |

Pst = PANEL STATUS
SCANNING SPEED = ONE HORIZONTAL TIME

TABLE 0

| NUMBER OF FLAGS | [PARTIALLY REWRITING INTERLACE] | [REFRESH INTERLACE] |
|---|---|---|
| 0 ~ 400 | 1 | 4 |
| 401 ~ 1024 | 2 | 6 |
| | | |

TABLE 1

| NUMBER OF FLAGS | [PARTIALLY REWRITING INTERLACE] | [REFRESH INTERLACE] |
|---|---|---|
| 0 ~ 250 | 1 | 5 |
| 251 ~ 750 | 2 | 8 |
| 751 ~ 1024 | 3 | 9 |

TABLE 2

| NUMBER OF FLAGS | [PARTIALLY REWRITING INTERLACE] | [REFRESH INTERLACE] |
|---|---|---|
| 0 ~ 200 | 1 | 6 |
| 201 ~ 600 | 2 | 8 |
| 601 ~ 1024 | 3 | 12 |

TABLE 3

| NUMBER OF FLAGS | [PARTIALLY REWRITING INTERLACE] | [REFRESH INTERLACE] |
|---|---|---|
| 0 ~ 150 | 1 | 7 |
| 151 ~ 400 | 2 | 8 |
| 401 ~ 1024 | 3 | 12 |

1 = 1 FIELD INTERLACE (NONINTERLACE)
2 = 2 FIELD INTERLACE (SKIP BY ONE)
3 = 3 FIELD INTERLACE (SKIP BY TWO)

DISPLAY CONTROL APPARATUS AND METHOD

BACKGROUND OF THE INVENTION

1. Field of the Invention

The present invention relates to a display control apparatus and, more particularly, to a display control of a display apparatus having a memory performance such as a ferroelectric liquid crystal (hereinafter, referred to as FLC) display apparatus or the like.

2. Related Background Art

In a computer display apparatus, the realization of a large screen and a high fineness is being progressed. Such a tendency is largely concerned with a fact that GUI (graphical user interface) is generally used as a user interface of a computer system.

Under the multiwindow environment of the GUI, it is preferable to use a display having a degree of fineness of at least 1000×1000 or more and a size of 15 inches or larger.

In the field of a flat panel display, the realization of a large screen and a high fineness is also similarly demanded.

There are at present several systems of flat panel display.

For example, there are a high time division driving system of a twisted nematic liquid crystal (STN), a system for a black and white display (NTN) and a plasma display system as modifications of the STN, and the like. Each of those systems has the same image data transfer method as that of the CRT. As a screen updating method, each of those systems uses a non-interlace method of a frame frequency of 60 Hz or higher. Therefore, the total number of scanning lines constructing one screen is equal to about 400 to 480. A flat panel display of a large size such that the total number of scanning lines constructing one screen is equal to or larger than 1000 is not yet obtained.

This is because since the above displays don't have a memory performance in terms of the driving principle, a refresh cycle of a frame frequency of 60 Hz or higher is necessary to prevent a flickering, so that there is a problem such that one horizontal scanning time is a short time of 10 to 50 $\mu$sec or less and a good contrast cannot be obtained.

A display apparatus using an FLC which can solve the above problem has been proposed.

The FLC has a "memory performance" as one of the characteristic features. The memory performance denotes that the liquid crystal cell holds a display state which was changed by applying a voltage. Such an FLC and an FLC display apparatus have been disclosed in detail in, for example, the Official Gazette of U.S. patent Ser. No. 4,964,699 by Inoue.

The display apparatus using the FLC can realize a display of a large screen and a high fineness because of its memory performance.

However, when a degree of fineness is high, the frame frequency is low. Therefore, the multi interlace (skip scan of a plurality of scanning lines) is needed to prevent the flickering. On the other hand, a partially rewriting scan (only the scanning lines in a rewriting area are scanned) method is necessary to have an enough display response speed as a computer display.

The partially rewriting scanning method has been clearly described in, for example, the Official Gazette of U.S. patent Serial No. 4,655,561 by Kanbe, et al.

Particularly, in the FLC display apparatus, the above partially rewriting scanning method is suitable for a moving display of a mouse, cursor, or the like, a scroll display of a multi window, or the like. The partially rewriting scan of two different areas cannot be executed in the same time, however, in case of a system such that the partially rewriting scan is executed by designating a start address and an end address of the partially rewriting scan, there is a problem such that the moving display of the mouse, cursor, or the like cannot be executed during the scroll display of the multi window.

For example, the scroll display of the window and the display of a pointing device will now be considered and their movements will now be presumed. First, a partially rewriting scanning request of the window scroll display is generated. The scroll partially rewriting scan is started for the display panel and, thereafter, the pointing device moves. In this state, however, the rewriting scan of the pointing cannot be executed until the completion of the scan of the final scanning line address of the window. Therefore, the pointing device discontinuously moves in accordance with the size (the number of partially rewriting scanning lines) of the window, so that there is a problem such that the moving display becomes obviously unnatural.

In the conventional partially rewriting scan, the updated area is displayed by only the non-interlace.

Therefore, when the partially rewriting area is large, a flickering occurs at the time of the partially rewriting scan because of a low frame frequency of the FLC display apparatus.

Particularly, when such a partially rewriting operations are continuously executed, an unpleasant feeling is given to the user and can result in a cause of a physical disorder by the VDT. Generally, when the non-interlace scan is performed at a frame frequency of 40 Hz or less, a flickering occurs.

As characteristics of the FLC, there is a problem such that when the partially rewriting scan is repeatedly executed, in case of an insufficient memory performance of the display panel, the contrast of the area in which the partially rewriting operation is not executed gradually deteriorates or the like.

SUMMARY OF THE INVENTION

Under such a background, it is an object of the present invention to solve the above problem and to realize a high speed display and a display quality which are suitable for a computer display by a partially rewriting scan even in a display apparatus of a low frame frequency.

To accomplish the above object, according to one preferred embodiment of the present invention, there is provided a display control apparatus comprising: display means which is constructed by using a display element having a memory performance; memory means for storing display data which is displayed on the display means; detecting means for detecting an area in which the data has been updated in the memory means; and control means for controlling the scan of the display means in a manner such that the data rewriting operation is executed by the skip scan of m lines for the scanning area of the display means corresponding to the area detected by the detecting means and that the data rewriting operation is performed by the skip scan of n lines for the scanning area of the display means corresponding to an area other than the area detected by the detecting means (where, m and n are set to integers of 0, 1, 2, 3, . . . and m<n).

The above and other objects, features, and advantages of the invention will become apparent from the following detailed description taken in conjunction with the appended claims with reference to the accompanying drawings.

BRIEF DESCRIPTION OF THE DRAWINGS

FIG. 8 is a diagram showing an example of panel status information which is sent from a display panel controller that is used in the display control algorithm according to the first embodiment and an example of interlaces corresponding to the panel status information;

FIG. 12 is a diagram showing an example of panel status information which is sent from a display panel controller that is used in the display control algorithm according to the second embodiment and also showing an example of interlace tables corresponding to the panel status information;

DETAILED DESCRIPTION OF THE PREFERRED EMBODIMENTS

Figure 1:
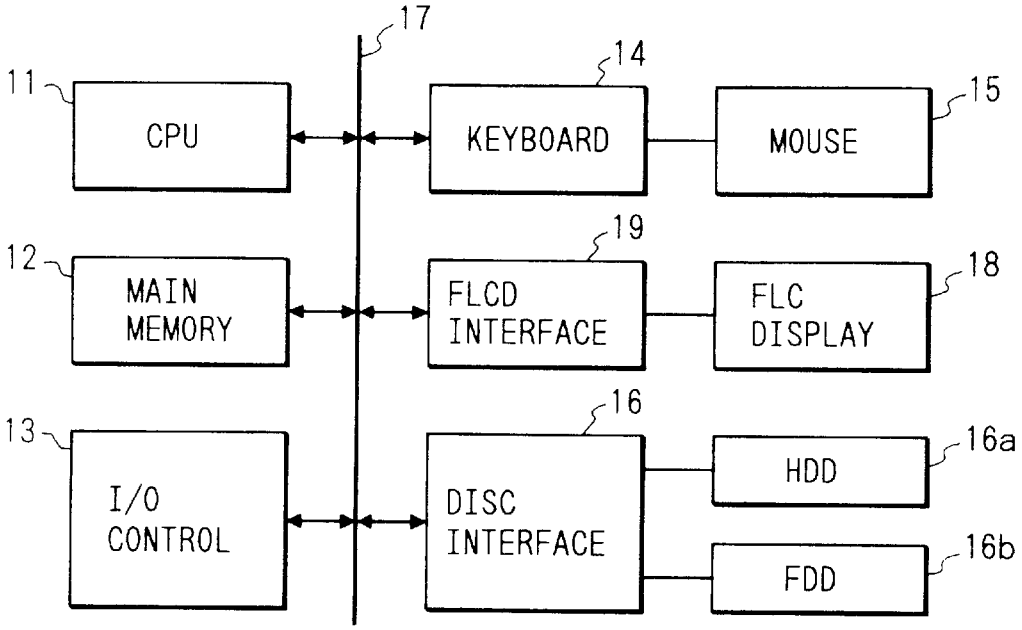
FIG. 1 is a block diagram showing a whole information processing system according to an embodiment of the invention.

FIG. 1 is a block diagram of an information processing system of an embodiment according to the present invention.

In FIG. 1, reference numeral 11 denotes a CPU to control the whole information processing system; 12 a main memory which is used to store programs of the CPU 11 or is used as a work area when the program is executed; 13 an input/output control apparatus (hereinafter, referred to as an I/O control) having an interface such as ES-232C and the like; 14 a keyboard to input character information, control information, or the like by the user; 15 a mouse as a pointing device; 16 a disk interface to control a hard disc drive 16*a* and a floppy disk drive 16*b* as external memory devices; 17 a bus system comprising a data bus, a control bus, and an address bus to connect signals among the above apparatuses; and 18 an FLC display whose display is controlled by an FLC display interface (hereinafter, referred to as an FLCD interface) 19.

Figure 2:
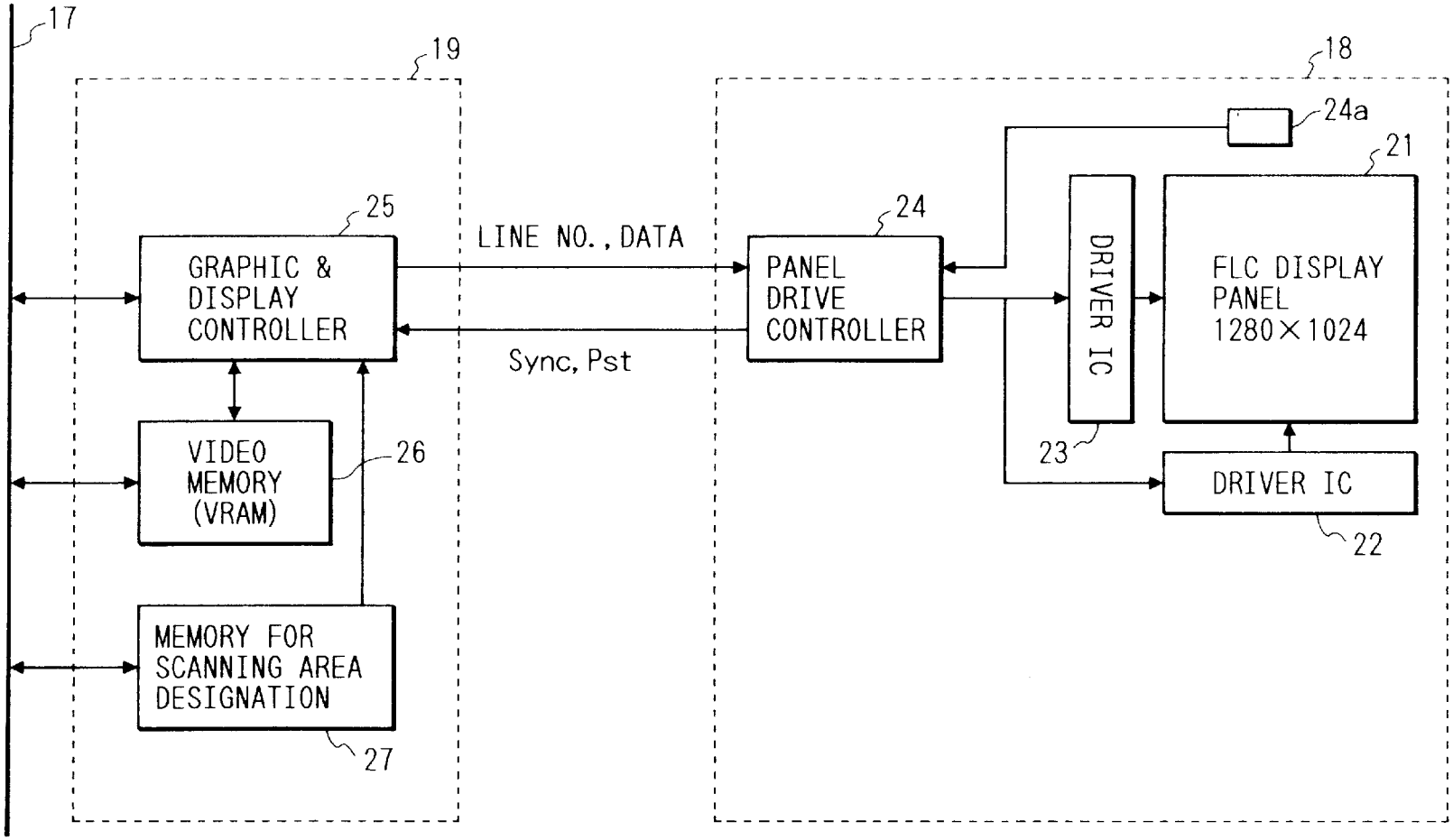
FIG. 2 is a block diagram showing constructions of an FLC interface and an FLC display according to an embodiment of the invention.

FIG. 2 is a block diagram showing the details of the portions of the FLCD interface 19 and FLC display 18 in FIG. 1.

An FLC display panel 21 is a ferroelectric liquid crystal display panel of a size of 15 inches and is constructed by arranging 1024 scanning electrodes and (1280×4) information electrodes in a matrix form. A ferroelectric liquid crystal is sealed in a space which is formed by two glass plates which were subjected to an orienting process. The information electrodes and scanning electrodes are connected to driver ICs 22 and 23, respectively.

Although the display panel has a resolution of 1024 pixels (in the vertical direction)×1280 pixels (in the lateral direction), one pixel is divided into subpixels having color filters of R, G, B, and W. Therefore, display states of 16 colors (4 bits/pixel) can be realized by one pixel by a combination of the lighting on/off states of the subpixels.

A video memory 26 is used to store display data. In the embodiment, a VRAM (video RAM) is used as a video memory 26.

A graphic & display controller 25 transfers both of the display data (Data in the diagram) of one scanning line in the video memory 26 and the scanning line address information (Line No. in the diagram) indicative of the scanning line to display the display data to a panel drive controller 24.

The controller 24 displays the transmitted data onto the scanning line corresponding to the scanning line address information.

By transferring the data with the scanning line address as mentioned above, the graphic & display controller 25 can freely control the scanning operation on the FLC display panel 21.

A memory 27 for scanning area designation is used to store information indicative of the area to be scanned on the panel.

Since the FLCD has a scanning speed depending on a temperature, it is necessary to generate a sync signal for data transfer from the FLCD side.

Therefore, a sync signal (Sync in the diagram) to transfer data of one scanning line and a panel status signal (Pst in the diagram) as a signal indicative of the present scanning speed of the display panel are supplied from the panel drive controller 24 to the graphic & display controller 25.

The panel drive controller 24 detects a temperature of the liquid crystal of the FLC display panel 21 by a temperature detecting section 24*a* and generates the sync signal in accordance with the result of the detection.

Figure 4:
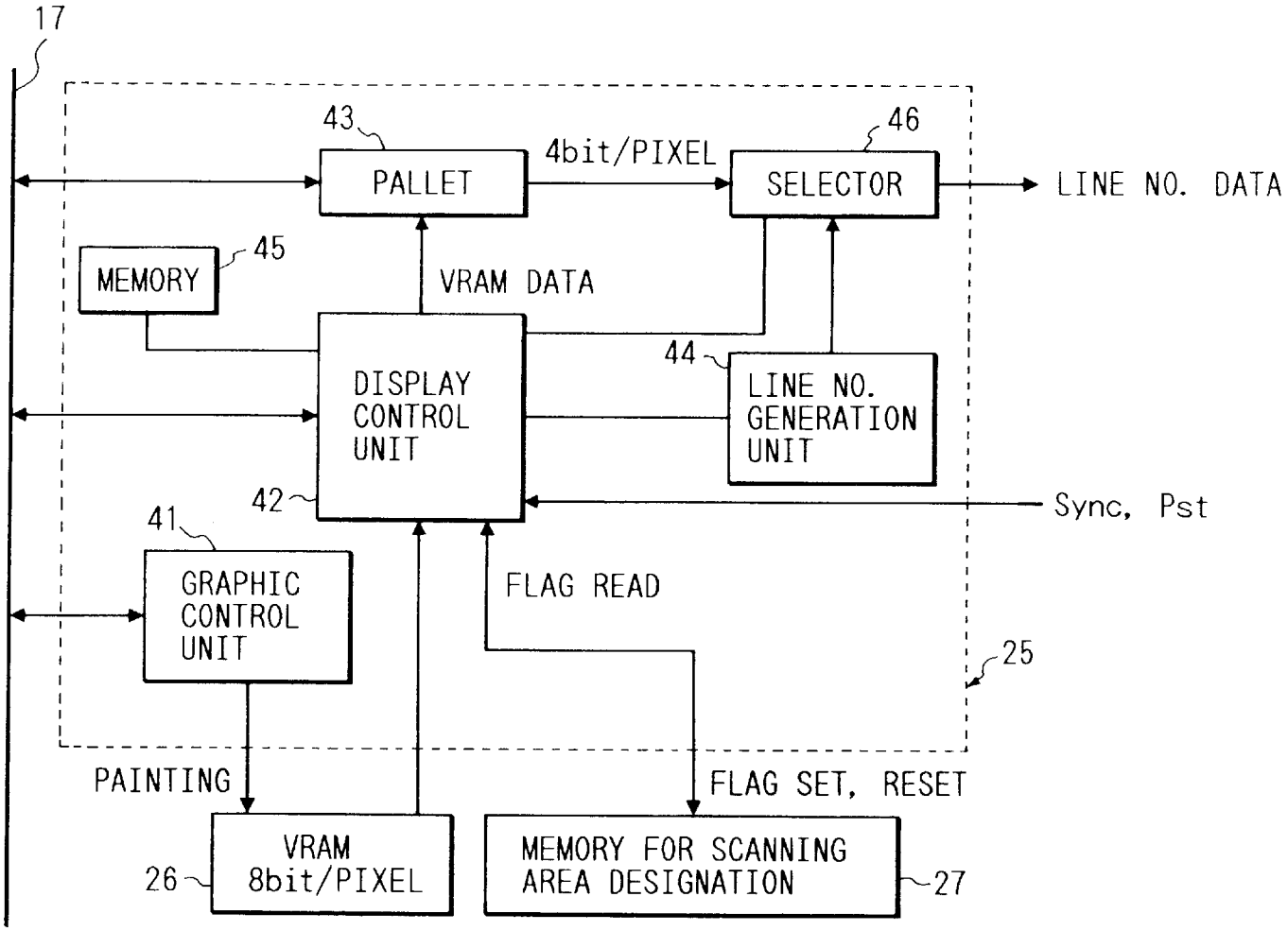
FIG. 4 is a block diagram showing the details of a graphic & display controller according to an embodiment of the invention.

FIG. 4 is a diagram showing the details of the graphic & display controller 25 in FIG. 2.

In FIG. 4, a graphic control unit 41 has a painting function (OutputText, DrawLine, DrawArc, Bitblt, etc.) to paint into the video memory at a high speed in accordance with a command from a host CPU.

A display control unit 42 executes the reading operation of data from the video memory, the generation of data to the FLCD, and the management of the memory for scanning area designation and is a portion to execute the display control method according to the invention.

A palette 43 is a portion to convert the data from the video memory 26 into video data (Data in the diagram) as combination information of ON/OFF of the actual pixels on the panel. Conversion information has previously been written in the palette 43 by the CPU 11 (refer to FIG. 1) or display control unit 42.

In the embodiment, since the FLC panel is constructed so that one pixel consists of four bits, the video data after conversion is set into [4 bits/pixel].

The display control unit 42 combines the video data which is generated from the palette and the line address (Line No. in the diagram) which is generated from an address generation unit 44 and outputs the resultant data.

A memory 45 is a portion in which data to set the operating mode of the output control unit has been stored.

Figure 3:
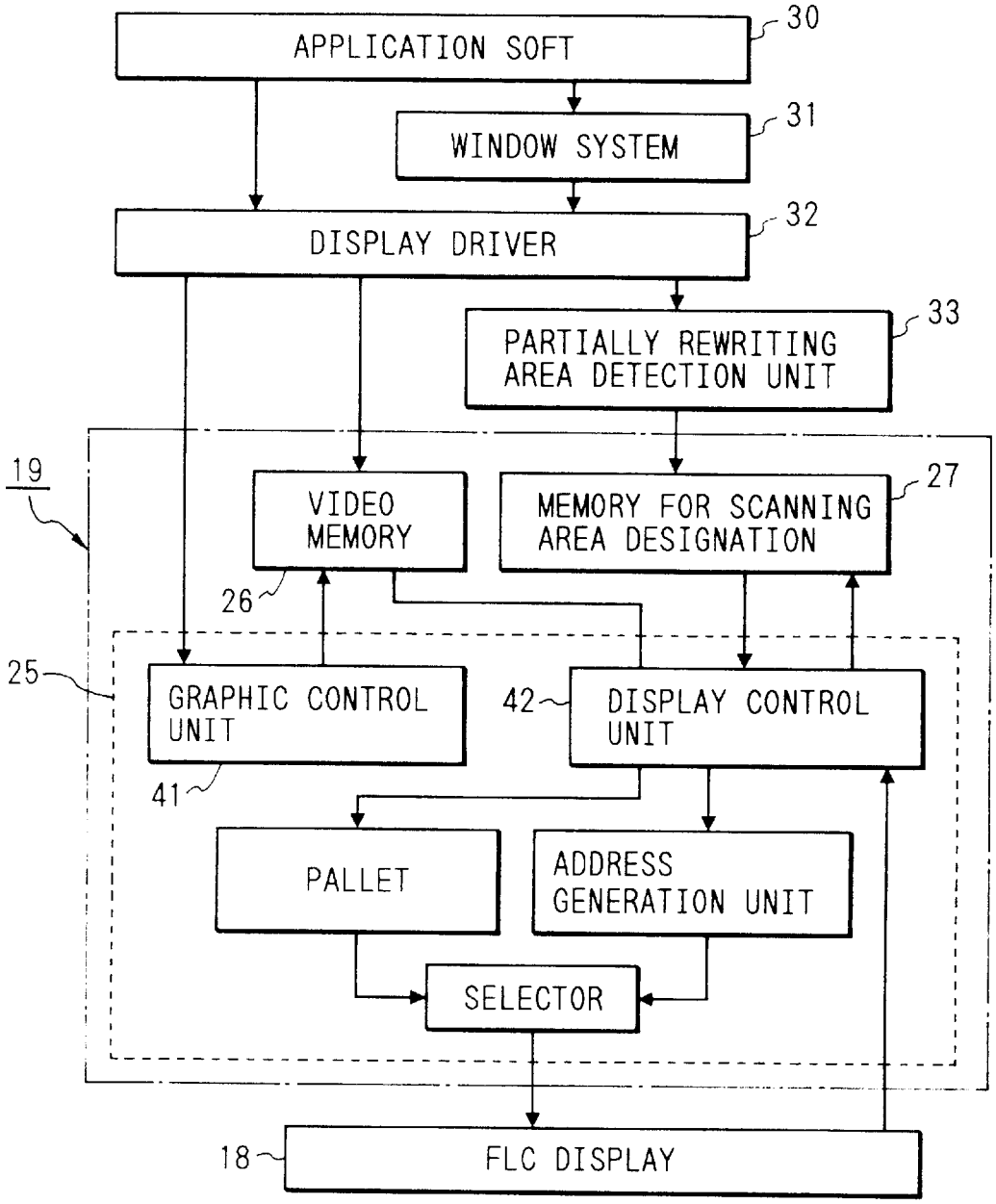
FIG. 3 is a diagram showing the relation between the FLC interface and the painting software according to an embodiment of the invention.

The relation between the FLC interface and the painting software will now be described hereinbelow with reference to FIG. 3.

An application software 30, a window system 31, and a display driver 32 are softwares which are operated by the host CPU.

Generally, when painting, the application software 30 directly supplies a pain-ting command to the display driver 32 or sends a protocol to the window system 31. The window system 31 supplies the painting command to the display driver 32.

The display driver 32 is a software to absorb a difference of the display device and is formed so as to match with the system of the embodiment.

The display driver 32 can also allow the video memory 26 to actually paint in accordance with the painting command from the application software 30 and window system 31.

The display driver 32 sends a command to the graphic control unit 41 of the graphic & display controller 25 and can also allow the graphic control unit 41 to actually paint.

As mentioned above, the graphic control unit 41 executes the painting to the video memory 26 in accordance with the command from the display driver 32.

In the embodiment, the graphic control unit 41 has a role to realize a high painting speed and is used to reduce the burden on the host CPU by performing the painting by the graphic control unit 41.

A partially rewriting area detection unit 33 detects the area in which the information in the video memory 26 was updated. Such area information is stored into the memory 27 for scanning area designation as a "flag", which will be explained hereinlater.

In the embodiment, the partially rewriting area detection unit 33 is accomplished by the software built in the display driver 32.

The relation between the information in the video memory 26 and the memory 27 for scanning area designation will now be described hereinbelow with reference to FIGS. 3 and 5.

Figure 5:
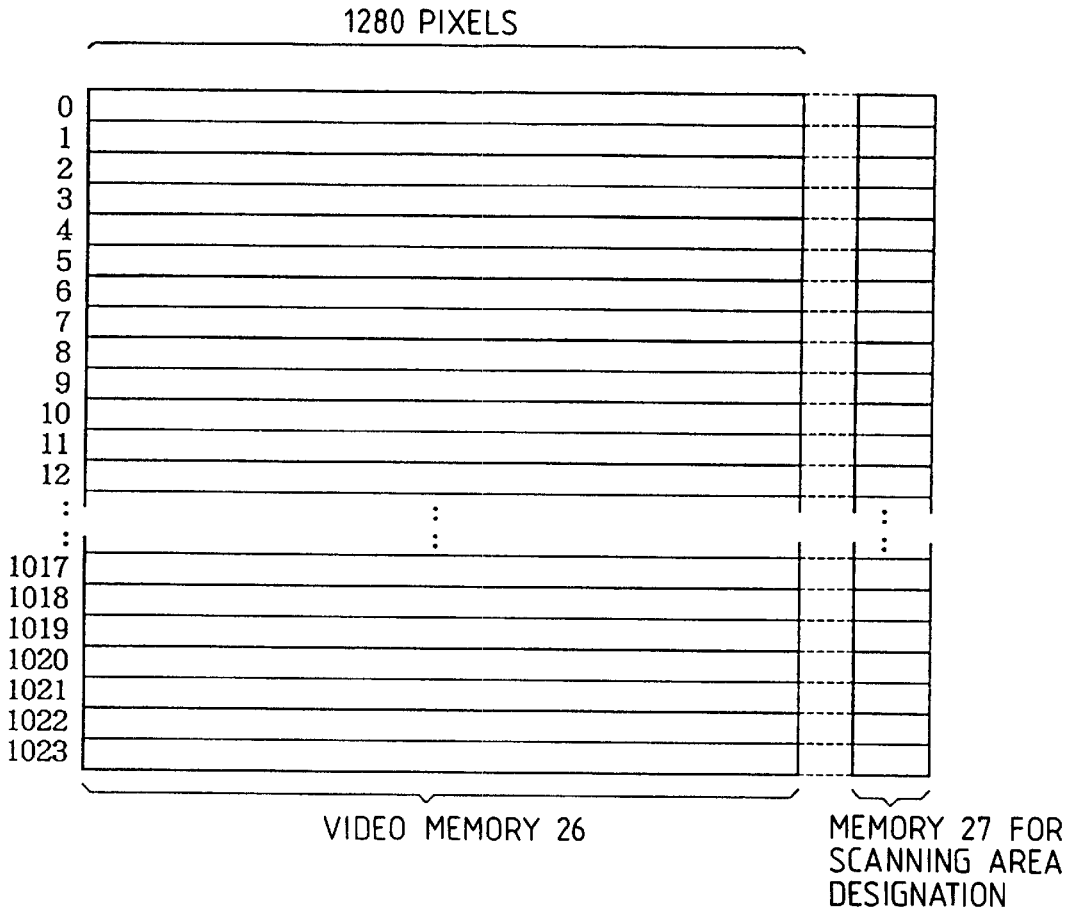
FIG. 5 is a diagram for explaining the relation between the video memory and the memory for a display area.

FIG. 5 is a diagram showing the relation between the information in the video memory 26 and the memory 27 according to the embodiment.

FIG. 5 shows a state in which one flag storing memory (memory for scanning area designation) corresponds to the information of one scanning line.

When the partially rewriting area detection unit 33 detects that the information has been updated, a flag is set into a flag register of the updated line.

The display control unit 42 in the graphic & display controller 25 decides the scanning line to be displayed in accordance with the "flag" as area information in the memory 27 and transfers the data to the display panel.

The display control unit 42 also has a function to also transfer the line address information as mentioned above when data is transferred.

Further, in order to refresh the areas other than the partially rewriting area, the display control unit 42 can also execute the writing operation of the flag into the memory 27 and the cleaning operation of the flag by itself.

The control operation of the embodiment of the display control unit 42 will now be described hereinbelow with reference to FIG. 6.

Figure 6:
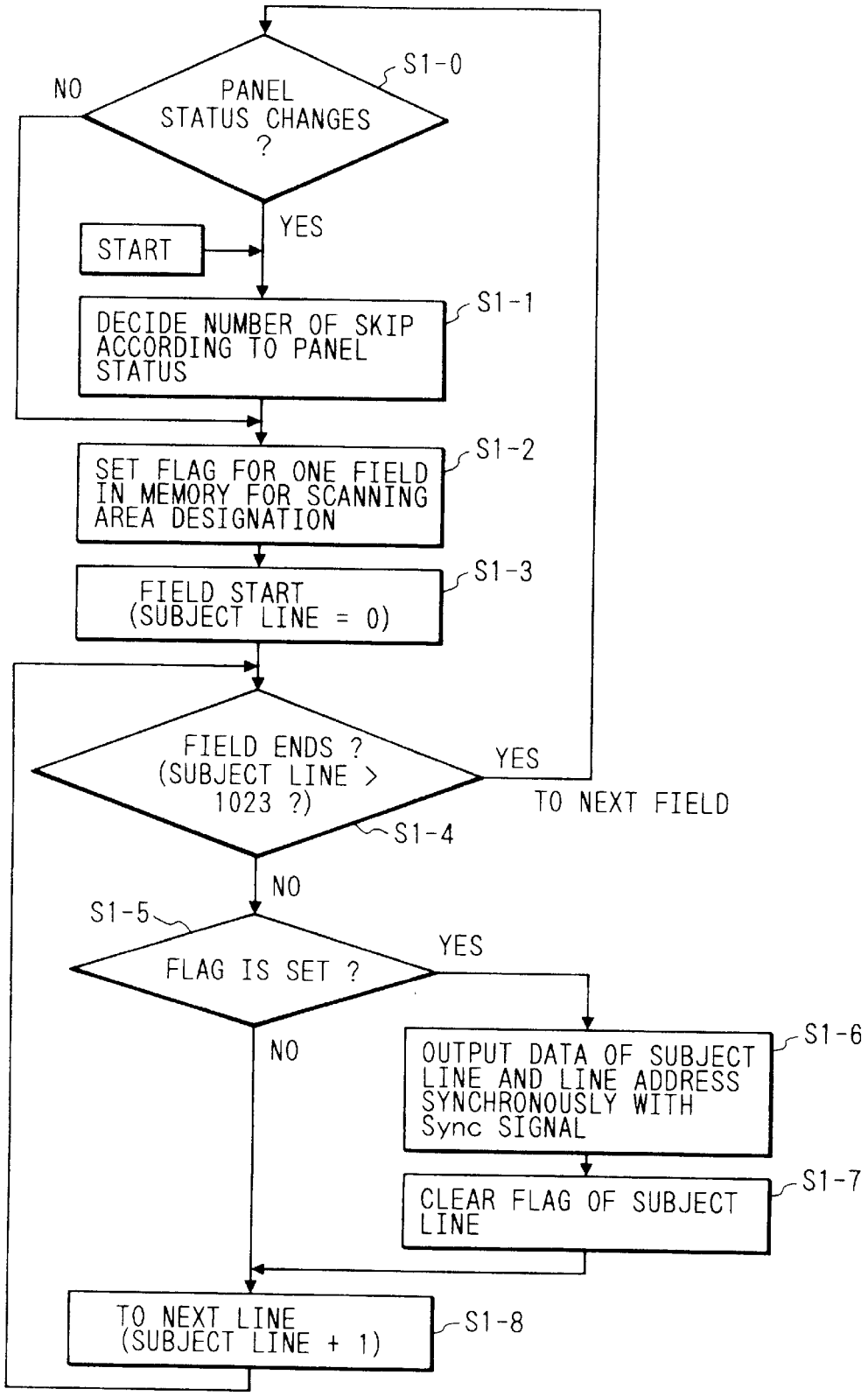
FIG. 6 is a flowchart for explaining an algorithm of the display control according to the first embodiment of the invention.

FIG. 6 is a diagram showing a algorithm of the display control method of the embodiment according to the invention.

For simplicity of explanation, it is now assumed that the partially rewriting operation is not executed at the beginning.

The display control unit 42 decides the number of scanning lines to be skipped in the skip scan (interlace) according to the panel status for the field end (step S1-1). A flag to refresh the next field is set into the memory 27 for scanning area designation (S1-2).

It is now defined that "field" means that the scanning operation is executed from the upper line to the lower line in the skip scan. "panel status" denotes information which reflects the scanning time of one line at the present temperature and is a signal (Pst) which is sent from the panel drive controller 24 (refer to FIG. 2) in the embodiment.

FIG. 8 shows examples the panel status information and field interlaces.

For example, when the scanning time of one line assumes 50 μsec, Pst=1.

In this case, when the number of scanning lines is equal to 1024, the frame frequency is equal to about 20 Hz, so that a flickering occurs in the non-interlace.

Therefore, the skip scan is needed.

In the embodiment, the relation between the panel status and the skip scan is determined as shown in FIG. 8. Such set information has been stored in the memory 45 in the graphic & display controller 25.

Explanation will be further made with reference to FIG. 6 again. In step S1-2, for example, it is assumed that a flag to execute the 3-field interlace as shown in FIG. 7 has been set.

The 3-field interlace (skip scan by two scanning lines) means that the whole frame can be scanned in the following three fields.

[(field 0) 0, 3, 6, 9, . . . / (field 1) 1, 4, 7, 10, . . . (field 2), 2, 5, 8, 11, . . . ]

Figure 7:
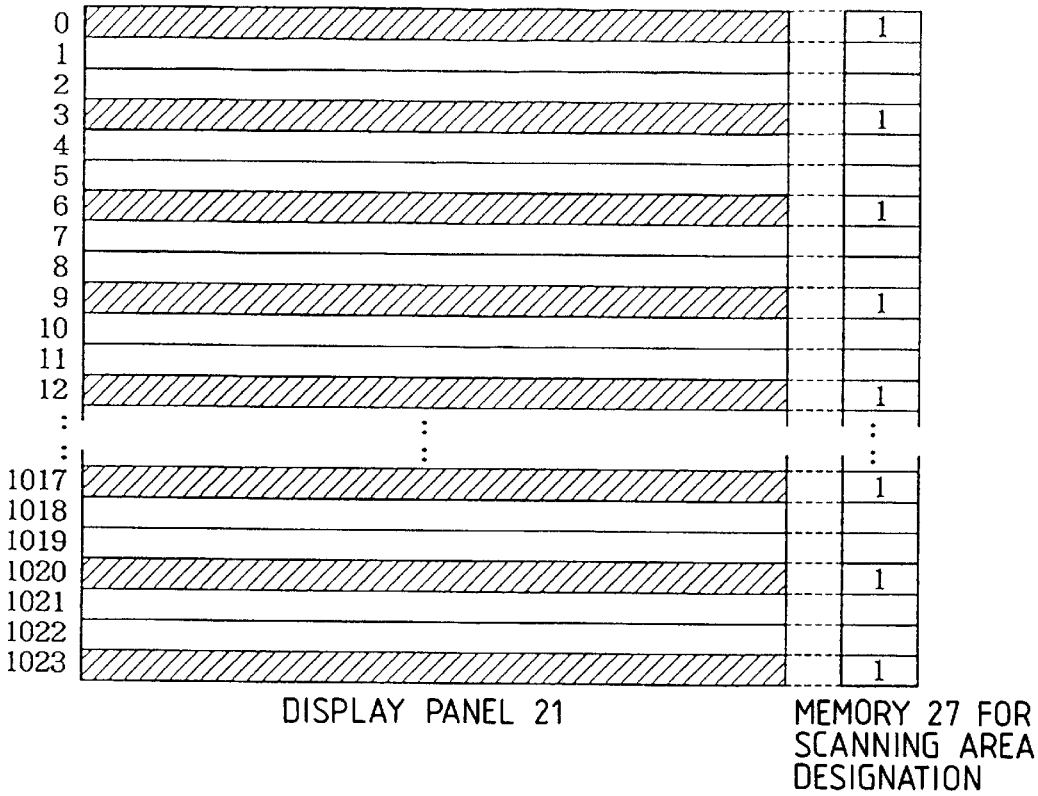
FIG. 7 is a diagram showing a state (the first scan) in which a flat has been set into a memory for scanning area designation to perform the 3-field interlace and lines to be scanned on a display panel in this instance.

In FIG. 7, the flags have been set into the scanning lines [0, 3, 6, 9, 12, . . . , 1020, 1023] in the field 0.

The display control unit 42 detects the presence or absence of the flag in the memory 27 from the top line (S1-3, S1-5).

When the flag is not set, the detecting process advances to the next line (S1-8).

When the flag has been set in the line, the data of this line is supplied to the FLCD 18 together with the line address information.

In this instance, the data and the line address information are outputted synchronously with the Sync signal from the panel drive controller 24 (S1-6).

After the data was outputted, the flag of the line is cleared (S1-7). In case of the field end (S1-4), a check is made to see if the panel status changed or not (S1-0). When there is no change, the flag to refresh the next field is set (S1-2).

When the panel status changes, the number of scanning lines skipped is counted in accordance with the setting as shown in FIG. 8.

By the above operations, the hatched portions shown in FIG. 7 are scanned and the scan of the field 0 of the 3-field interlace is executed.

When the above operations are sequentially executed for the field 1, field 2, . . . , the whole frame is scanned.

The operation in the case where the partially rewriting operation is executed by the display control algorithm will now be described hereinbelow.

Figure 9:
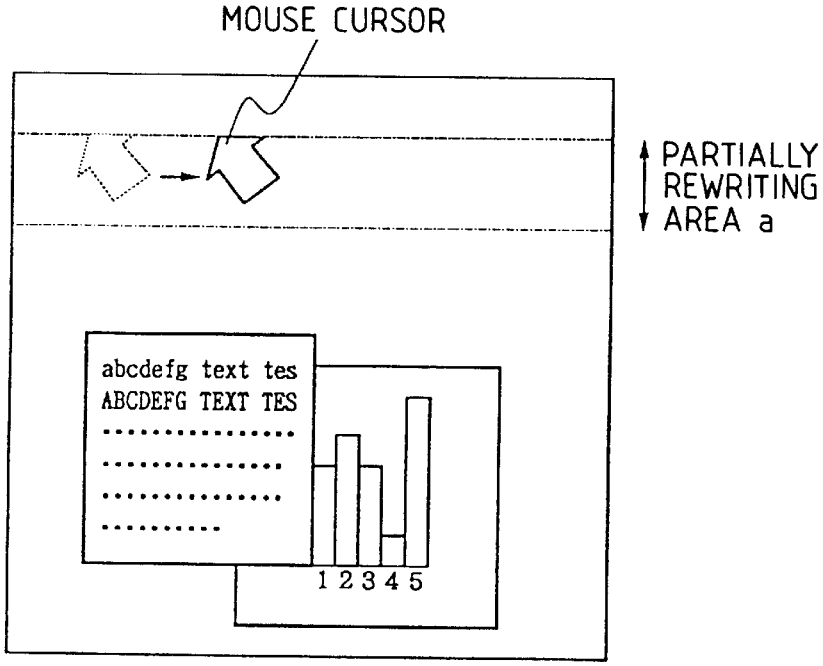
FIG. 9 is a diagram for explaining the partially rewriting operation and also shows a state in which a mouse was moved.

FIG. 9 shows a state in which the mouse cursor was moved on the window system.

Figure 10:
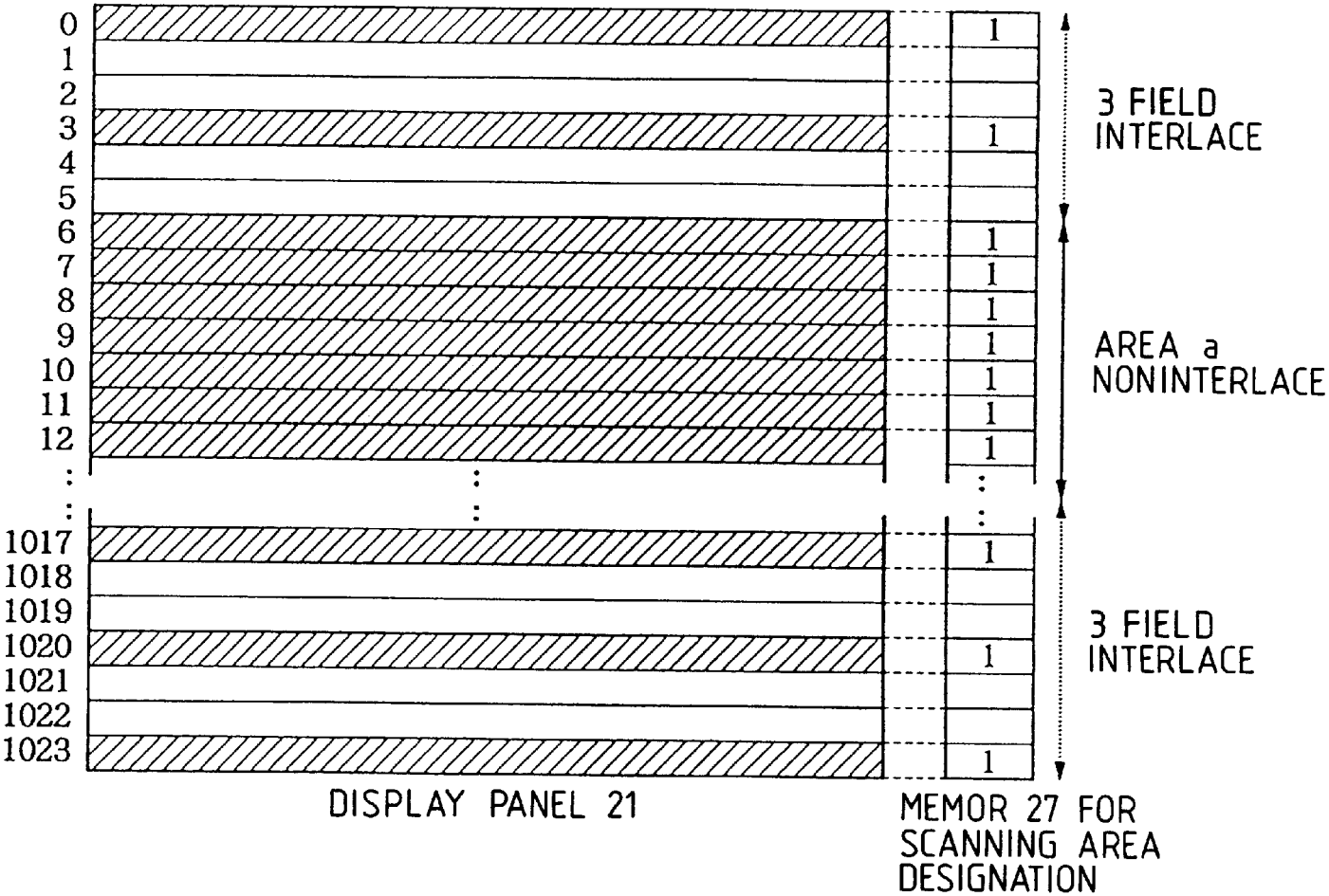
FIG. 10 is a diagram showing a state (the first scan) of setting of flags in the memory for scanning area designation based on the display control algorithm according to the first embodiment in the case where the mouse was moved as shown in FIG. 9 and also showing lines to be scanned on the display panel.

When the data in the video memory 26 is rewritten by the display driver 32 or graphic control unit 41, the partially rewriting area detection unit 33 sets the flag (area a in the diagram) of the rewritten area. FIG. 10 shows such a state.

In FIG. 10, the flags of the lines 0, 3, 6, 9, . . . , 1017, 1020, and 1023 are flags which have been set into the field ends by the display control unit in step [S1-2] in FIG. 6. The flags of the lines 6, 7, 8, 9, . . . are flags which have been overrewritten by the partially rewriting area detection unit 33.

When the data of the lines in which the flags have been set in steps [S1-5, S1-6, S1-7, and S1-8] is outputted, the hatched portions in this field are scanned.

That is, the area in which the display has been changed is subjected to the non-interlace. The other locations are subjected to the 3-field interlace. Therefore, the area in which the display was changed is displayed at a priority higher than the priorities of the other areas.

The case where the above partially rewriting operation was repeatedly executed will now be considered.

Now, assuming that the mouse cursor in FIG. 9 continuously moved and the flags of the same number as that of the area a were always set, a display period of the mouse is set as follows in the case where the scanning time of one line is equal to 50μsec.

In the case where the partially rewriting operation is not executed: about 20 Hz In the case where the embodiment is applied:

$$\text{about 56 Hz} = 20\ \text{Hz} \times \text{the number of scanning lines} / \text{the number of flags}$$

$$= 20\ \text{Hz} \times 1024 / \{32 + (1024 - 32) / 3\}$$

(It is calculated on the assumption that the 3-field interlace is executed and the size of mouse font is set to 32×32)

When the data is rewritten at 56 Hz, it is possible to display a mouse cursor which smoothly moves without a difference from that in case of the CRT.

The control operation of another embodiment of the display control unit 42 will now be described hereinbelow with reference to FIG. 11.

Figure 11:
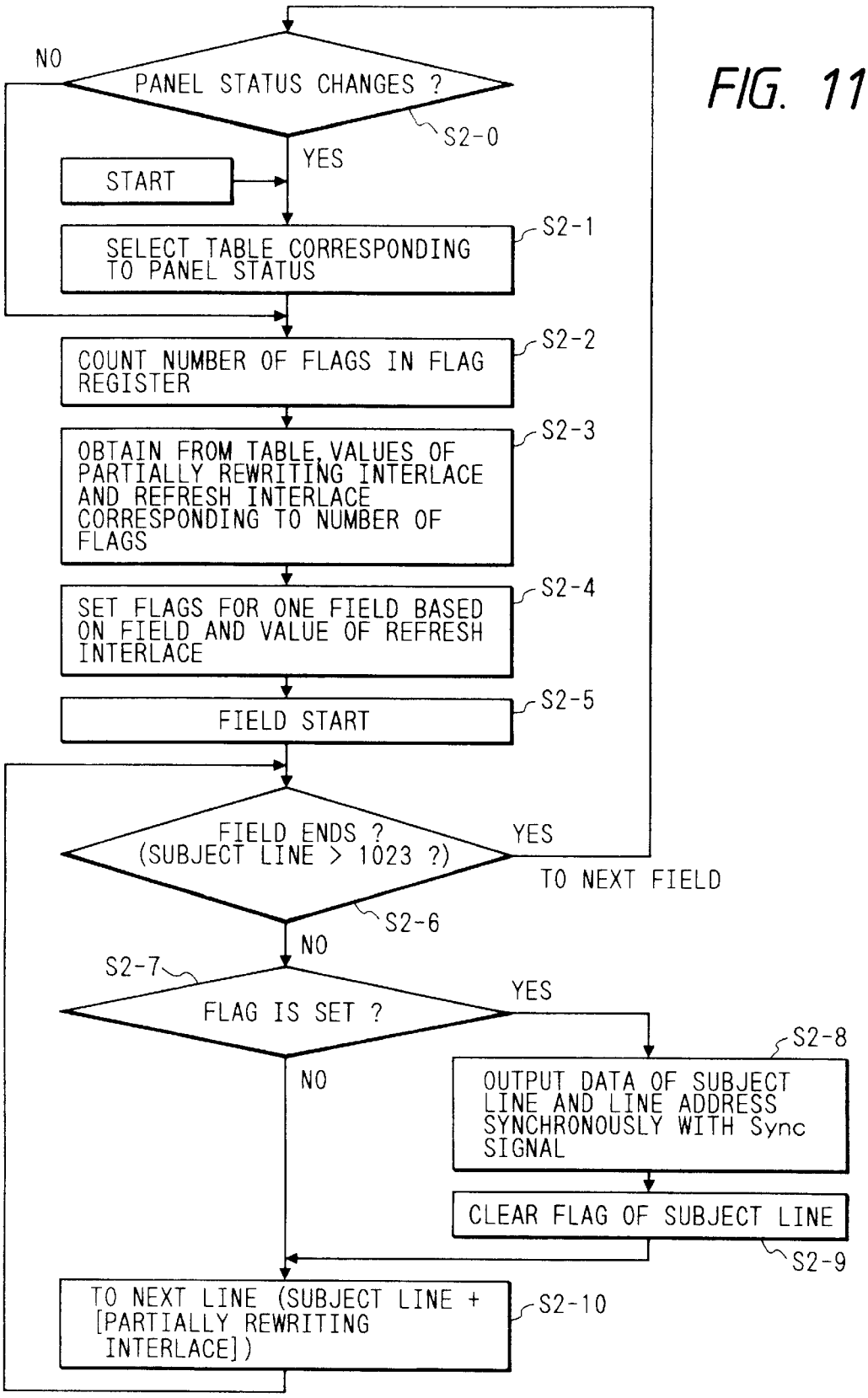
FIG. 11 is a flowchart for explaining an algorithm for display control according to the second embodiment of the invention.

FIG. 11 is a diagram showing an algorithm of the display control method of another embodiment according to the present invention. For simplicity of explanation, a scanning speed of the FLCD is set to 100 μsec and it is assumed that the partially rewriting operation is not executed at the beginning.

The display control unit 42 selects an interlace table (hereinafter, simply referred to as a table) according to the panel status for the field end (S2-1).

The "panel status" mentioned here denotes the information which reflects the present scanning speed of one line of the liquid crystal and denotes the signal (Pst) which is sent from the panel drive controller 24 (refer to FIG. 2) in the embodiment.

FIG. 12 shows examples of interlace tables. These tables have been stored in the memory 45 (refer to FIG. 4). Set values in those tables are different in accordance with the panel statuses. The information in the table indicates the values of the partially rewriting interlace and the refresh interlace according to the number of flags.

The display control unit 42 counts the number of flags in the memory 27 (S2-2). The number of flags indicates the size of partially rewriting area.

The values of the partially rewriting interlace and refresh interlace are obtained from the tables shown in FIG. 12 in accordance with the number of flags (S2-3). Since it is now assumed that the partially rewriting operation is not executed, the number of flags is equal to 0 and [partially rewriting interlace ]=1 (non-interlace) and [refresh interlace]=6 (6-field interlace=skip scan of five scanning lines) from the table 2.

The display control unit 42 sets the flag to refresh the data of one field into the memory 27 for scanning area designation on the basis of the refresh interlace and the present field (0 in the initial state) (S2-4).

Figure 13:
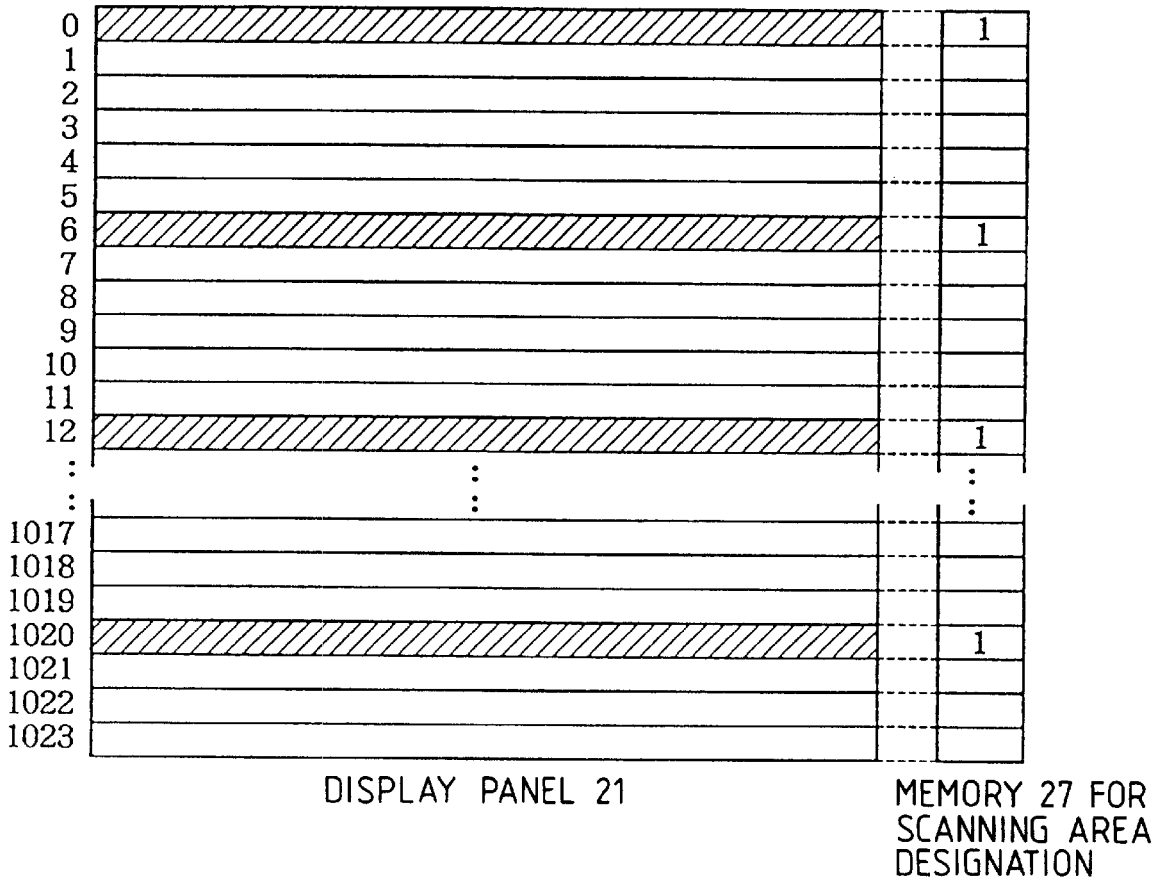
FIG. 13 is a diagram showing a state (the first scan) in which flags have been set into the memory for scanning area designation in order to perform the 6-field interlace and also showing lines to be scanned on the display panel in this instance.

FIG. 13 shows a state in which the flag to perform the 6-field interlace has been set. In the field 0, the flags of the scanning lines shown by hatched regions (0, 6, 12, . . . , 1014, 1020) are set.

After the above setting operation was finished, the display control unit 42 searches the flag in the memory 27 (S2-5, S2-7, S2-8).

The number of scanning lines which are skipped is determined by the value of the partially rewriting interlace.

Since the partially rewriting interlace=1 here, the skip scan is not performed. Namely, the subject line is increased one by one (S2-8).

When the flag has been set in the subject line, the data of this line is supplied to the FLCD 18 together with the line address information synchronously with the Sync signal from the panel drive controller 24 (S2-8).

After the data was generated, the flag of this line is cleared (S2-9).

When the field end comes (S2-6), a check is made to see if the panel status has changed or not (S2-0). When there is no change, the flag to refresh the next field is set (S2-2).

When the panel status changes, the table according to the panel status is selected from the tables shown in FIG. 12 (S2-0, S2-1).

By the above-described operation, the data of the lines shown by hatched regions in FIG. 13 is generated.

By repeating the above operations while changing the fields, the multi interlace refresh can be executed. In this embodiment, since the 6-field interlace is executed, one frame is displayed by repeating the above operations six times while sequentially changing the field.

The operation in case of executing the partially rewriting operation by the above display control algorithm will now be described hereinbelow. It is now assumed that the scanning speed of the FLCD is similarly set to 100 μsec.

As shown in FIG. 9, the partially rewriting operation will now be described on the assumption that the mouse cursor of a size of 30×30 moved on the window system as shown in FIG. 9.

When the display driver 32 or graphic control unit 41 rewrites the data in the video memory 26, the partially rewriting area detection unit 33 sets the flag (in the diagram: partially rewriting area a=30 lines) of the rewritten area.

Figure 14:
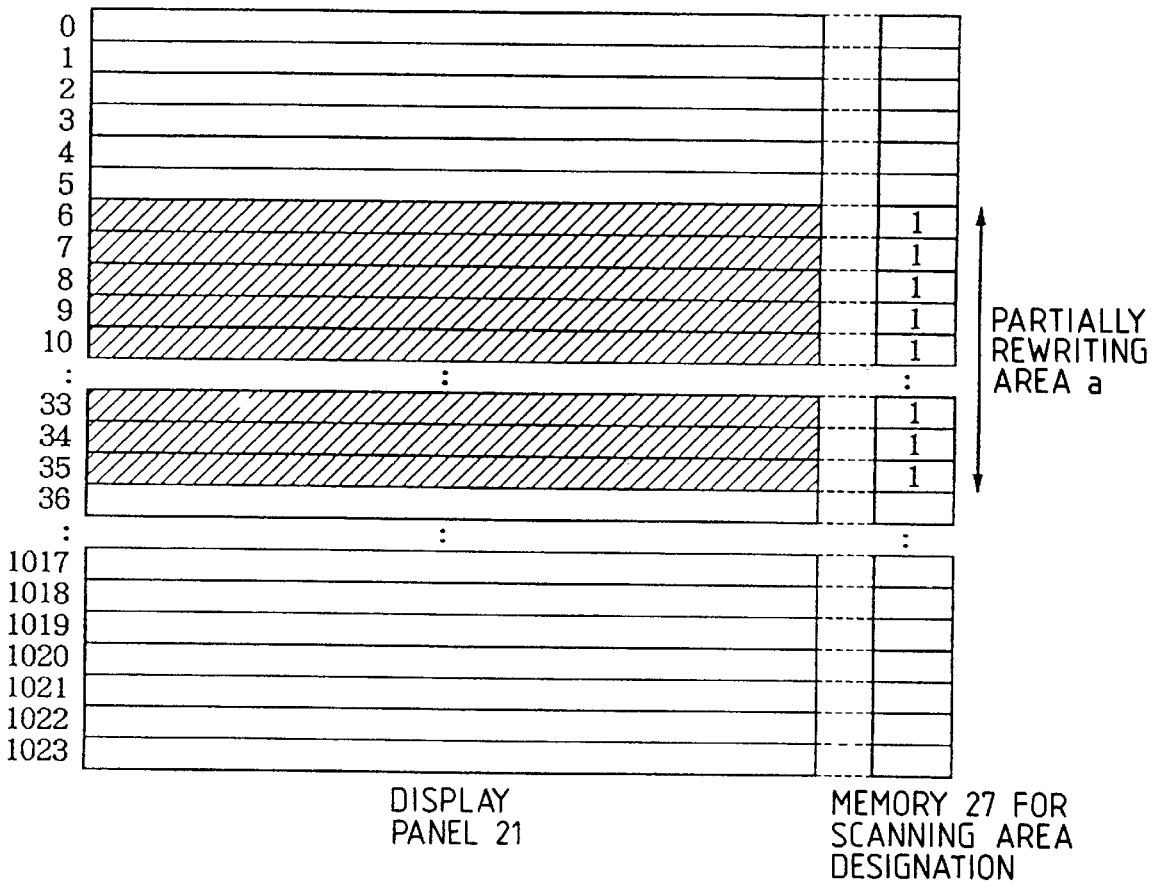
FIG. 14 is a diagram showing a state (only the partially rewriting portion) of setting of flags into the memory for scanning area designation in the case where the mouse was moved as shown in FIG. 9 and also showing lines to be scanned on the display panel.

FIG. 14 shows the correspondence between the flags set as mentioned above and the display panel 21. The flags of the lines 6, 7, 8, 9, . . . , 35, and 36 are set by the partially rewriting area detection unit 33.

Now, assuming that the flags have been set in the field end as mentioned above, the number of flags in step S2-2 is equal to 30, so that (partially rewriting interlace)=1 and (refresh interlace)=6 from the table 2 in FIG. 12.

Figure 15:
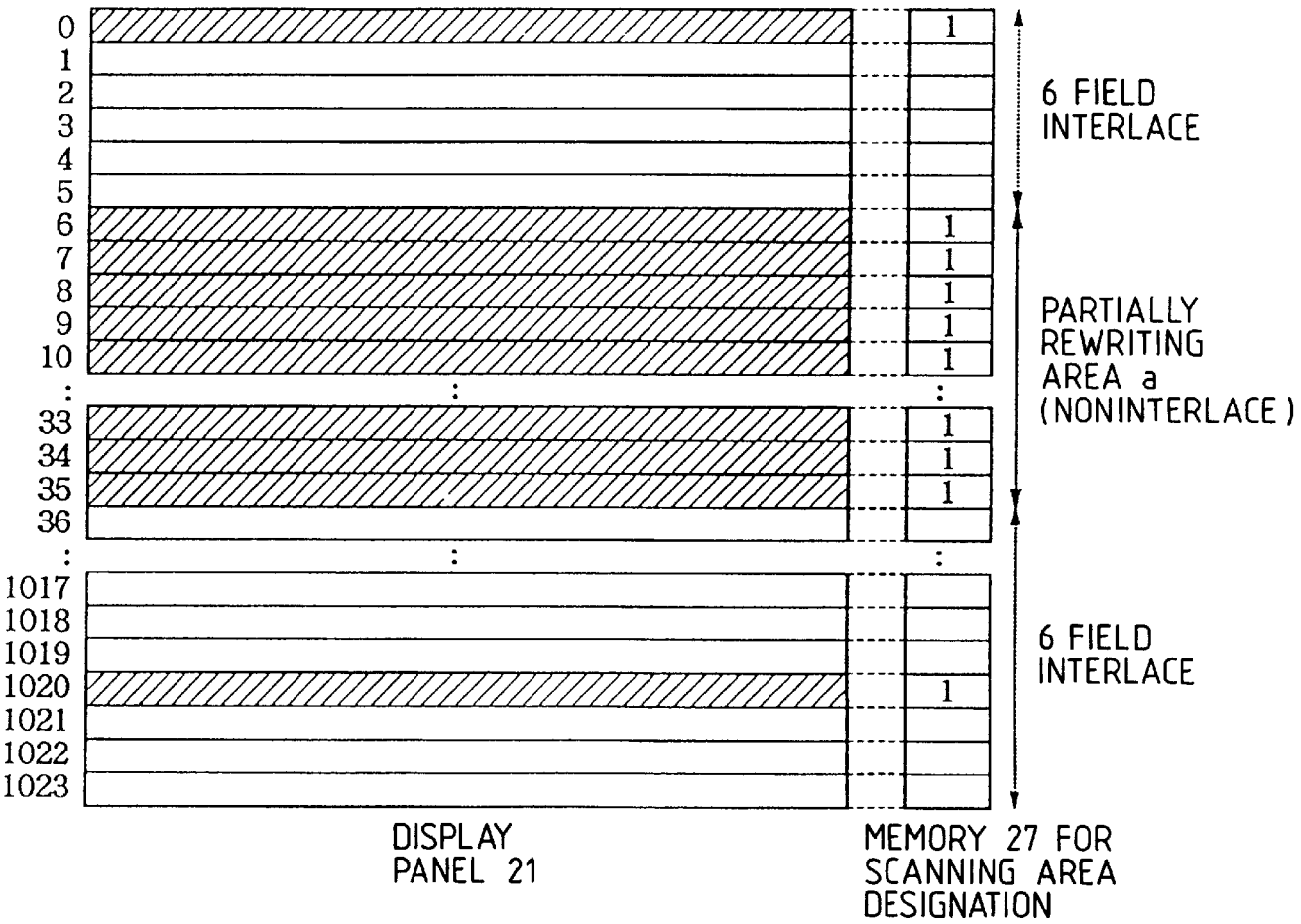
FIG. 15 is a diagram showing a state of setting of flags into the memory for scanning area designation in the case where the mouse was moved as shown in FIG. 9 and also showing lines to be scanned on the display panel.

Therefore, 170 (=1024÷6) scanning lines are set every six refreshing flags. The lines shown by hatched regions in FIG. 15 are scanned in steps (S2-7, S2-8, S2-9, S2-10).

That is, in the embodiment, the area whose display content was changed is set into the non-interlace (no skip scan is executed). The other locations are set into the 6-field interlace. Therefore, the area whose display content was changed is displayed at a priority higher than the priorities of the other areas.

The case where the above operations were repeatedly executed will now be considered.

When it is now assumed that the mouse cursor in FIG. 9 continuously moves as it is and the flags of the same number as the area a have always been set, a display period in the case where one line scanning time assumes 100 μsec is as follows.

In the case where the partially rewriting operation is not executed: about 10 Hz (=frame period)

In the case where the partially rewriting operation according to the embodiment was executed:

$$10\ \text{Hz} \times (\text{the number of scanning lines} / \text{the number of flags})$$

-continued $$= 10\ \text{Hz} \times [1024/\{30 + (1024 - 30)/6\}]$$

$$= \text{about } 52\ \text{Hz}$$

When the data is changed at a frequency of 52 Hz, the display content is hardly different from that in case of the CRT and the mouse which can smoothly move can be displayed. When the frequency is equal to 52 Hz, the flickering due to the partially rewriting operation doesn't occur.

The case of partially rewriting a large area will now be described.

The case of scroll an area whose height (the number of scanning lines) is equal to 800 will now be considered. A scanning time of one line assumes 100 μsec.

Figure 16:
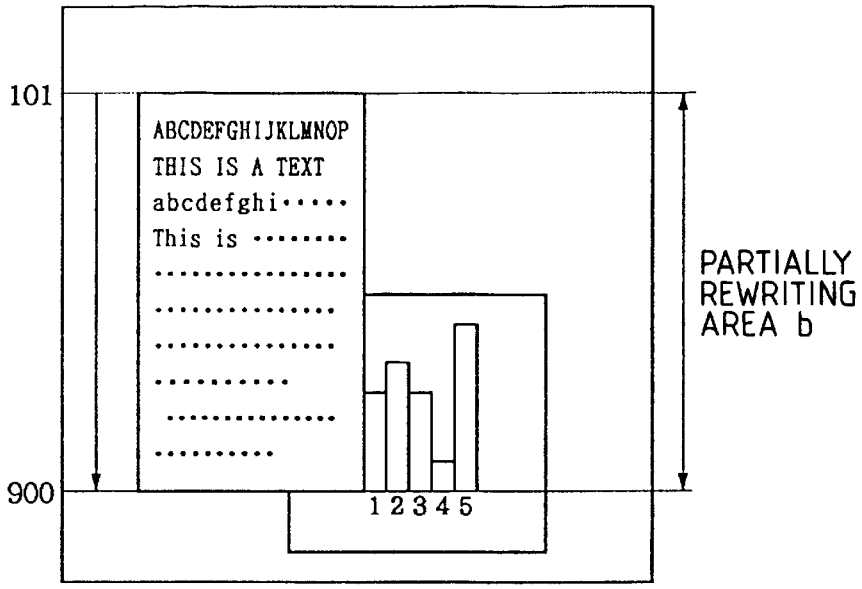
FIG. 16 is a diagram for explaining the partially rewriting operation and also shows a state in which the scroll was executed.

FIG. 16 shows a state in which the area of a height (the number of scanning lines) is equal to 800.

Figure 17:
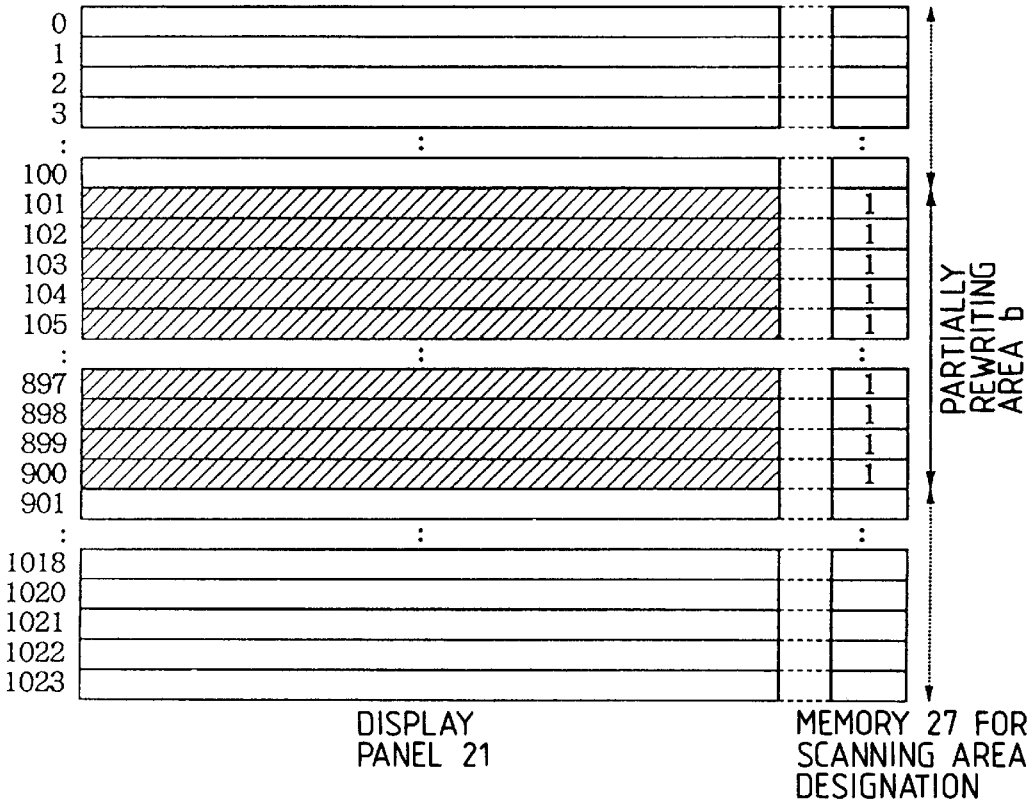
FIG. 17 is a diagram showing a state (only the partially rewriting portion) of setting of flags into the memory for scanning area designation in the case where the scroll was executed as shown in FIG. 16 and also showing lines to be scanned on the display panel.
Figure 18:
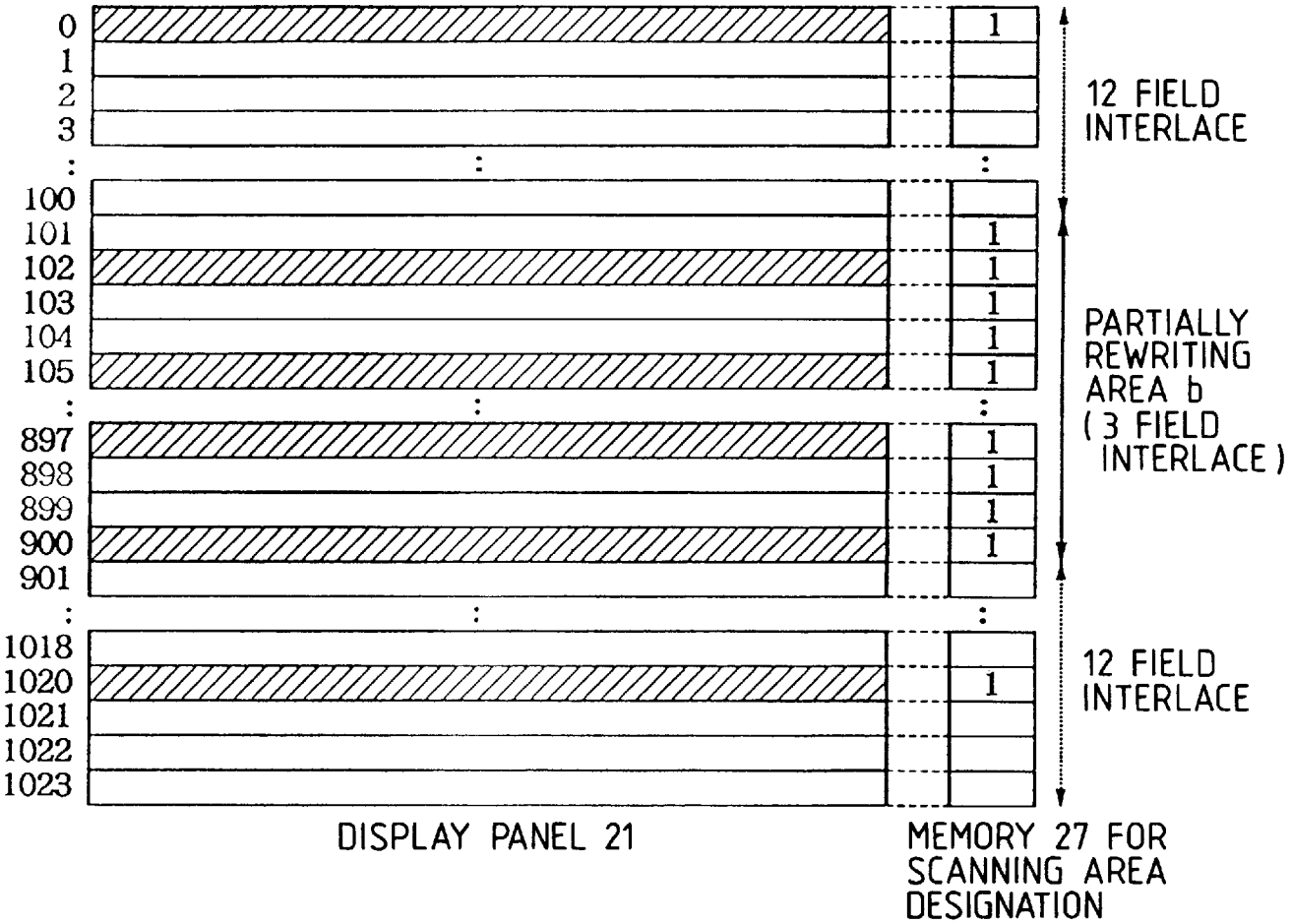
FIG. 18 is a diagram showing a state of setting of flags into the memory for scanning area designation in the case where the scroll was executed as shown in FIG. 16 and also showing lines (at the first scan) to be scanned on the display panel.

FIG. 17 is a diagram showing a state in which the flags corresponding to the height (partially rewriting areas b in the diagram) of the scroll area have been set in the memory 27 for scanning area designation.

Now, assuming that the flag has been set in the field end as mentioned above, the number of flags in step S2-2 is equal to 800, [part-ally rewriting interlace]=3 and [refresh interface]=12 are recognized from the table 2 in FIG. 12.

Therefore, 1024/12=85 scanning lines are set every twelve refreshing flags. After that, the display control unit 42 searches the flag in the memory 27 while skipping the scanning lines (S2-5, S2-7, S2-8).

In case of the embodiment, when [partially rewriting interlace]=3, the subject line is increased by +3 at a time.

In the embodiment, even when searching the flag while skipping the scanning lines, the line in which the flag has been set for refreshing is certainly set to the subject line. Therefore, the tables (FIG. 12) are set so that [refresh interlace] is set to a value which is a common multiple of [partially rewriting interlace]. The first subject line in each field is also decided from the field for refreshing.

For example, when it is assumed that [refresh interlace]=12 and [partially rewriting interlace]=3, in the field in which the flag for refreshing has been set to [0, 12, 24, 36, . . . ], the subject line is increased to [0, 3, 6, 9, 12, . . . ]. In the field in which the flag for refreshing has been set to [1, 13, 25, 37, . . . ], the subject line is increased to [1, 4, 7, 10, 13, . . . ], so that the flag which has been set for refreshing is certainly detected.

By the operations as mentioned above, the lines shown by hatched regions in FIG. 14 are scanned in one field. The lines which are not scanned in the partially rewriting area are scanned in the next or subsequent line.

In case of the embodiment, the area whose display was changed is set to the 3-field interlace and the other locations are set into the 12-field interlace.

In this case as well, therefore, the area whose display was changed is displayed at a priority higher than the priorities of the other areas.

The case where the above operations were repeatedly executed will now be considered.

When it is now assumed that the scrolling operation in FIG. 16 was continued and the same number of flags as that in the area b have always been set, a display period when the scanning time of one line assumes 100 μsec is equal to about 10 Hz (=frame frequency).

In the case where the partially rewriting operation was executed by the non-interlace, $$10\ \text{Hz} \times (\text{the number of scanning line} / \text{the number of flags}$$
$$= 10\ \text{Hz} \times [1024/\{800 + (1024 - 800)/12\}]$$
$$= \text{about } 12\ \text{Hz}$$

In the case where the partially rewriting operation according to the invention was performed (3-field interlace):

$$10\ \text{Hz} \times (\text{the number of scanning lines} / \text{the number of flags})$$
$$= 10\ \text{Hz} \times [1024/\{800/3 + (1024 - 800)/12\}]$$
$$= \text{about } 36\ \text{Hz}$$

In the case where the partially rewriting operation was executed by non-interlace, the display is performed at 12 Hz, so that a fairly large flickering occurs.

On the other hand, in case of performing the display control of the embodiment, the 3-field interlace is executed, so that the display is performed at 36 Hz and the flickering hardly occurs.

As will be obviously understood from the above description, according to the display control method of the embodiment, since the area whose display was changed is preferentially operated, even when a display device of a low frame frequency is used, the display content can be changed at an enough high speed.

When the partial rewriting area is large, the partially rewriting scan is executed by the interlace in which the number of scanning lines to be skipped is small such that so called a "dispersion" is inconspicuous, so that the flickering due to the partially rewriting operation can be suppressed.

On the other hand, since the areas other than the partially rewriting area are also periodically refresh, there is not a large difference between the numbers of scanning times per unit time of the partially rewriting area and the area which is not partially rewritten. There is also a feature such that a disturbance of the display such as a difference of the contrast due to an incompletion of the memory performance of the FLC hardly occurs.

Figure 19:
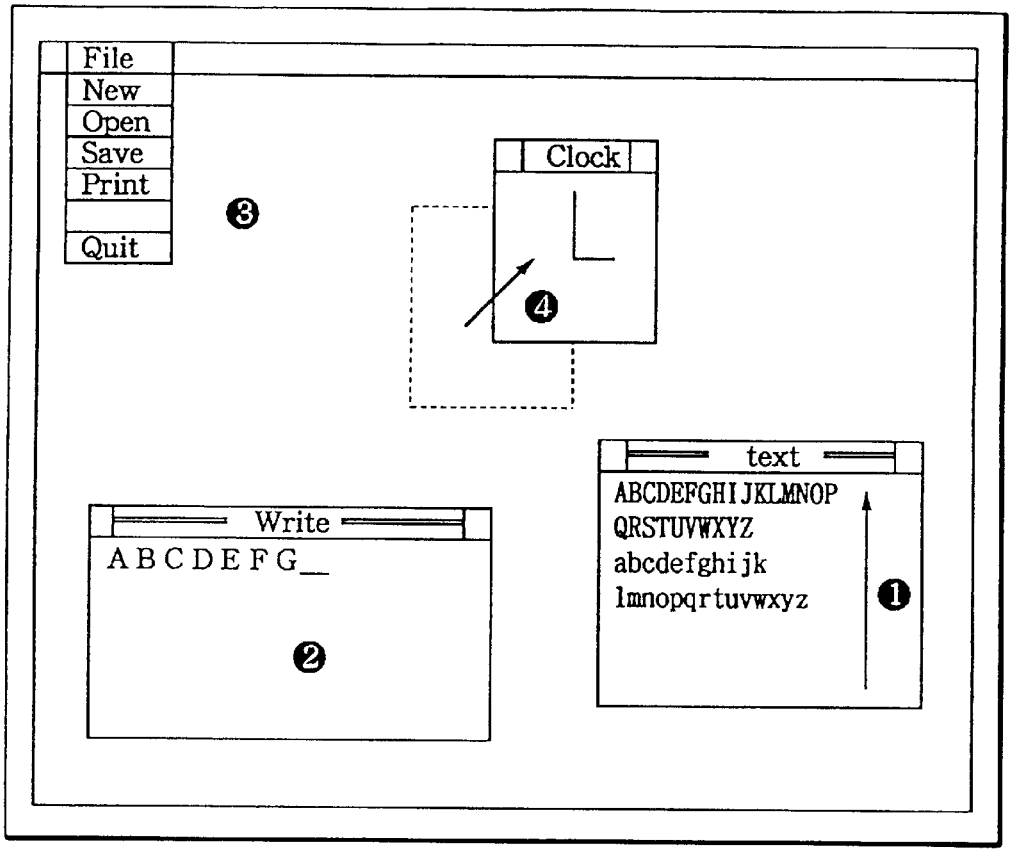
FIG. 19 is a diagram showing an example of painting events other than the mouse and scroll.

Although each of the above embodiment has been described with respect to the example in which the movement of the mouse cursor and the scroll have been used as painting events, the painting events are not limited to them. FIG. 19 shows several examples of the other painting events. In FIG. 19, ① to ④ denote the following painting events.

① Scroll of the text display
② Text display in association with the key input
③ Top-up menu display
④ Movement of the window In the above embodiments, the scanning speed of the FLCD has been set to 100 $\mu$sec. However, since the scanning speed actually changes depending on the temperature of the liquid crystal, as shown in FIG. 12, by switching the table in accordance with the scanning speed of the FLCD, the optimum values of the [partially rewriting] and [refresh interlace] can be always obtained. That is, according to the embodiment, the skip scan of the partially rewriting operation and refreshing operation can be changed in accordance with the scanning speed of the panel.

In the embodiment, although only the example in which the scanning operation is executed in the lower direction (line 0 → 1023) has been shown, the invention is not limited to such an example. The scanning operation can be also executed in the upper direction (line 1023 → 0).

In the embodiment, although the partially rewriting area detection unit 33 has been accomplished by the software built in the display driver 32, it is not limited to such an example from a viewpoint of the spirit of the present invention. For example, it is also possible to provide a similar function into the painting function of the graphic control unit 41 in the graphic & display controller 25. Or, the data updating area can be also recognized by adding address monitor means for monitoring the access to the video memory.

Figure 20:
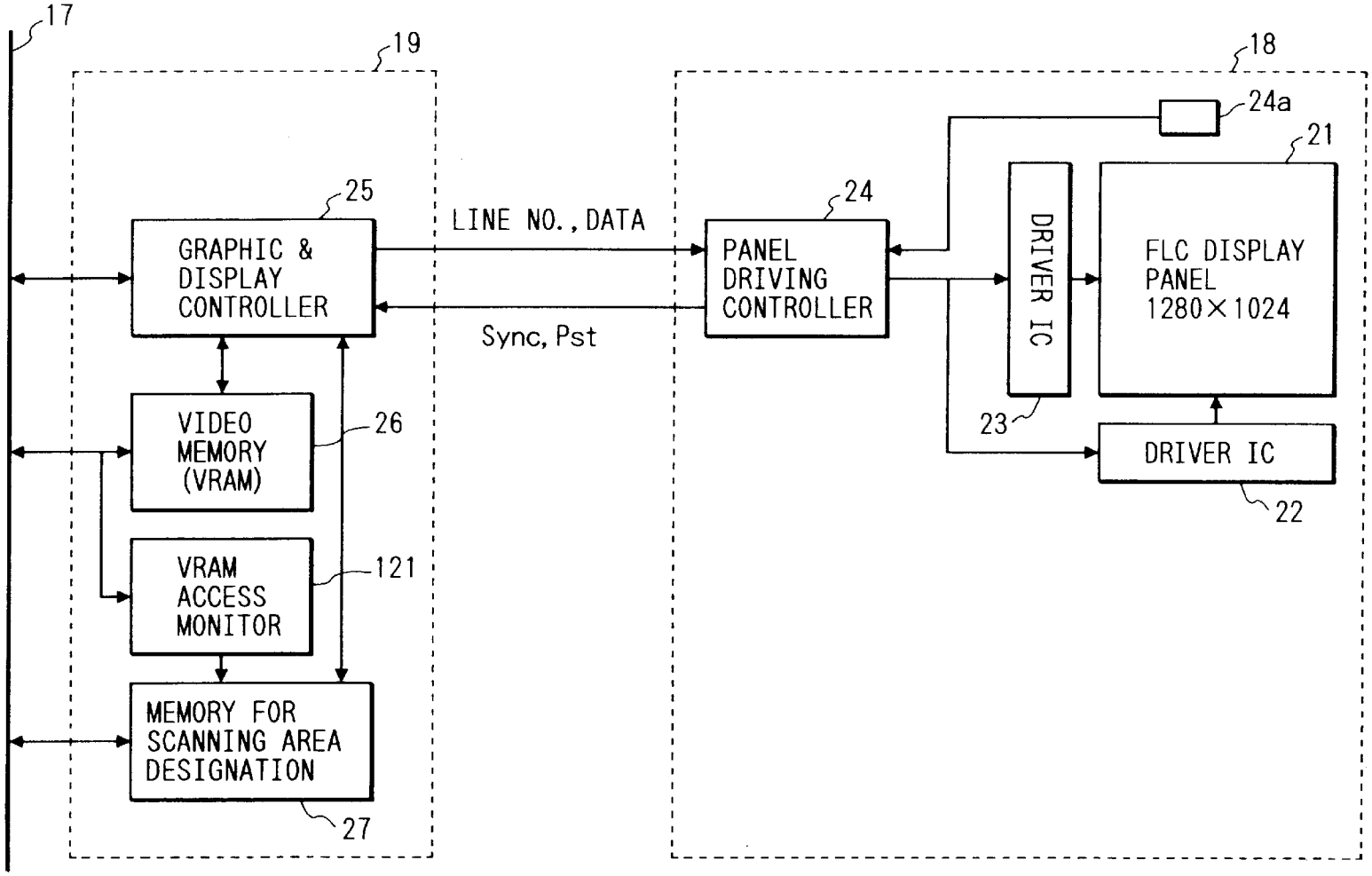
FIG. 20 is a block diagram showing a construction in case of replacing partially rewriting area detecting means by a VRAM address monitor.

FIG. 20 is a block diagram showing an example in the case where such address monitor means is used. FIG. 20 corresponds to FIG. 2. In FIG. 20, the same or similar component elements as those shown in FIG. 2 are designated by the same reference numerals and their descriptions are omitted.

In FIG. 20, reference numeral 121 denotes means for monitoring the access to the VRAM which is executed via the bus system 17. The access monitor 121 detects the accessed location in the VRAM 26 and stores the detected location as a flag into the memory 27 for scanning area designation. A similar effect can be also derived by the control method with such a construction.

The FLC panel used in the embodiment can display only sixteen colors because one pixel is constructed by RGBW (4 bits/pixel). However, the colors more than sixteen colors can be displayed by expression the color by a combination of several pixels by using an image processing technique such as a dither method or the like.

Figure 21:
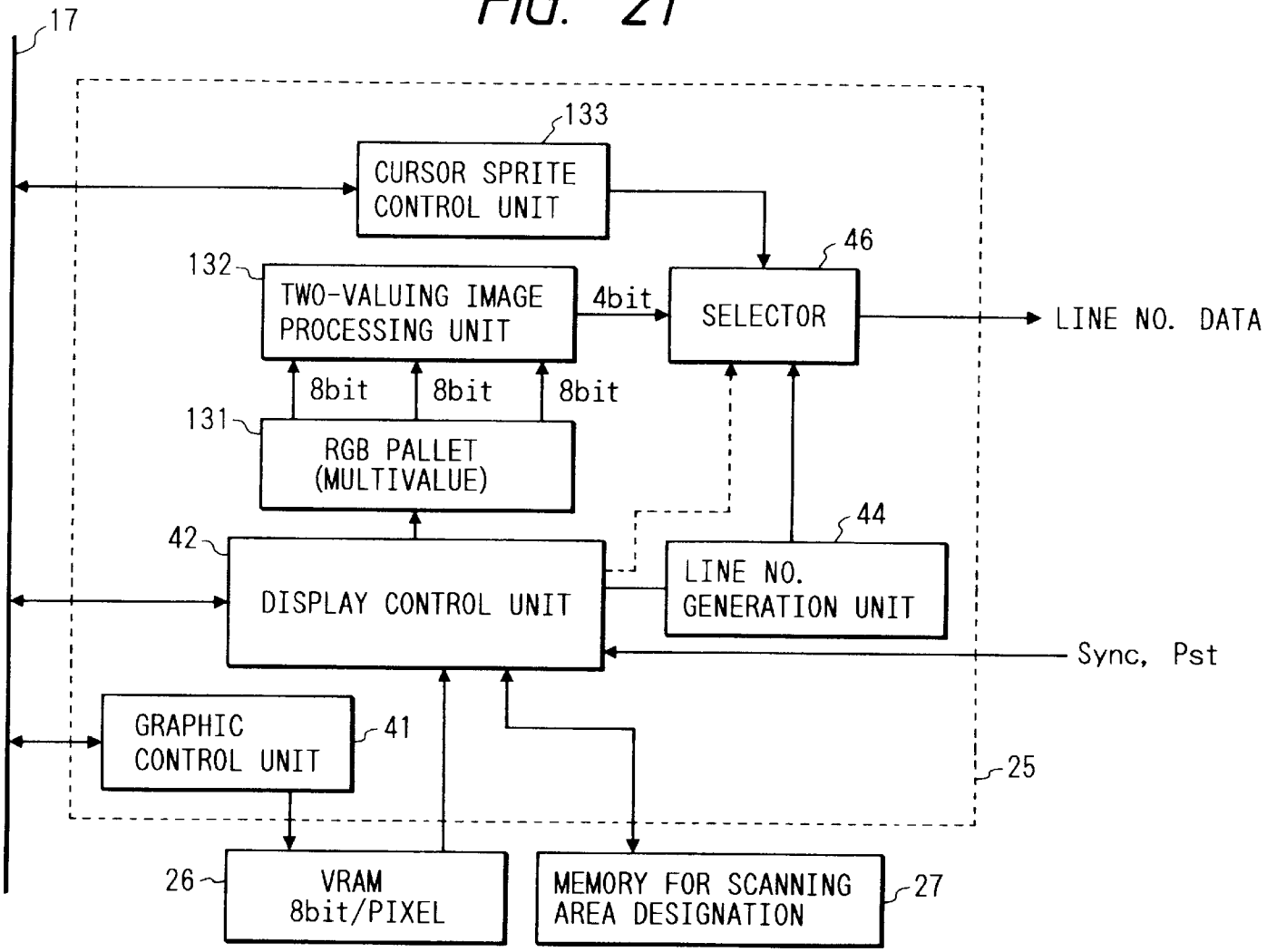
FIG. 21 is a block diagram showing a construction in the case where a control method according to the invention is used for an interface including an image processing function.

FIG. 21 is a block diagram showing a case where the function to execute image processes is added to the palette stage of the graphic & display controller shown in FIG. 4.

In FIG. 21, the same or similar component elements as those shown in FIG. 4 are designated by the same reference numerals and their descriptions are omitted here.

Reference numeral 131 denotes a palette like a palette which is generally used in the CRT. The palette 131 uses the data in the VRAM as an index and data of eight bits of each of R, G, and B is generated.

Reference numeral 132 denotes a two-valuing image processing section for performing an image process on the basis of the above RGB data and converts into the actual ON/OFF data (binary data) of the FLC panel which is used in the embodiment.

In the example, a cursor sprite control is executed at the output stage. The "cursor sprite" denotes that the cursor of a mouse or the like is not drawn in the video memory but when the image data is outputted to the display, it is synthesized to the cursor data from a cursor sprite control unit 133, thereby eliminating a load of the mouse drawing on the host CPU. Even when such a construction is used, the display controls shown in FIGS. 6 and 11 is effective as it is.

Figure 22:
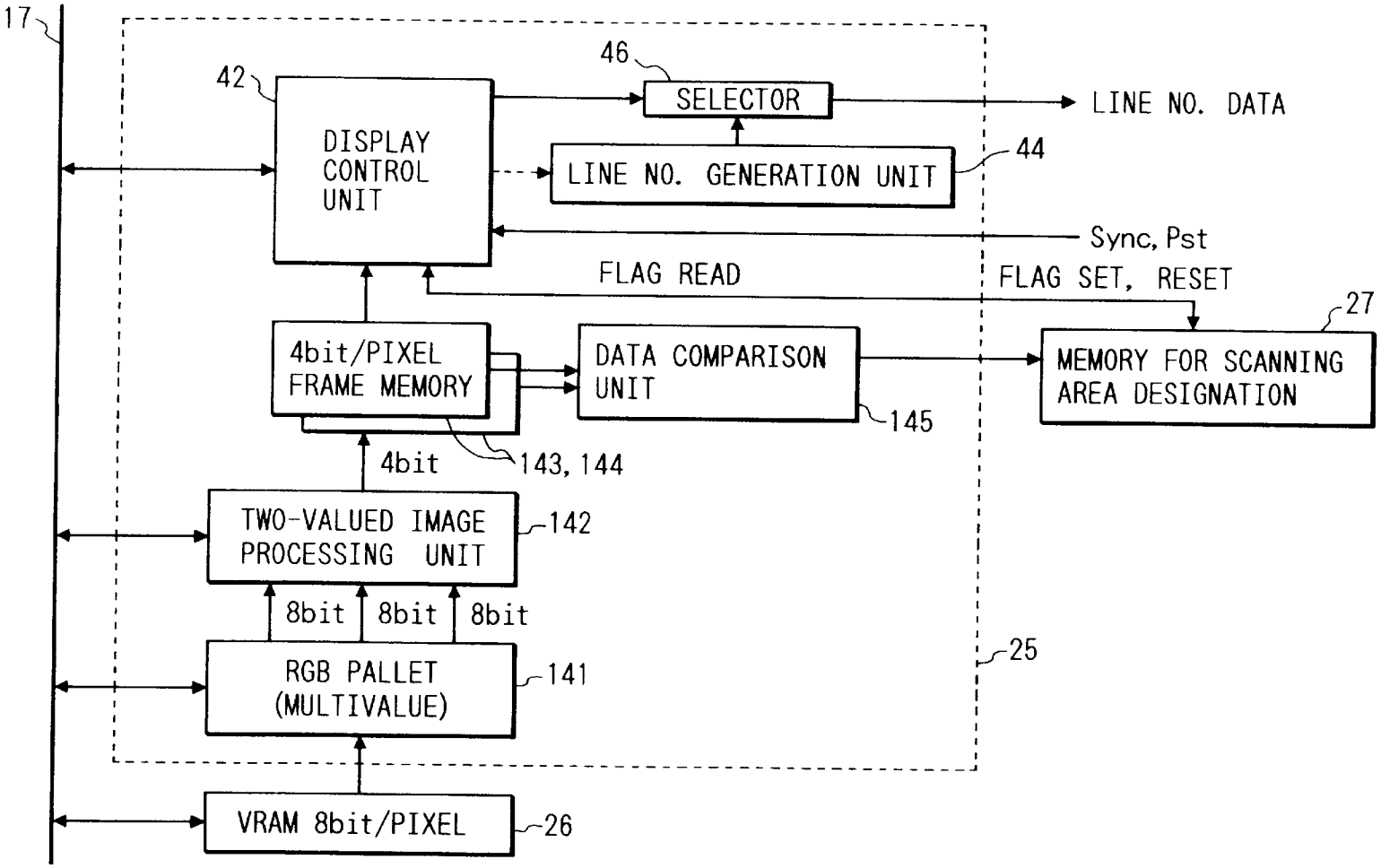
FIG. 22 is a block diagram showing another construction in the case where the control method according to the invention is used in the interface including the image processing function.

FIG. 22 is a diagram showing a system which can express sixteen or more colors by image processes in a manner similar to the example of FIG. 21. According to such a system, the data (4 bits/pixel) which has been binarized by the image process is once stored into a frame memory 143.

In the embodiment of FIG. 22, the partially rewriting area detection unit also uses a method different from that in the above embodiment.

Data which is generated from an RGB palette 141 is converted into ON/OFF data (binary data) on the panel by a two-valuing image processing unit 142. The graphic & display controller 25 has two frame memories 143 and 144 for the binary data. The latest frame data is stored in one of those frame memories and the preceding frame data is stored in the other frame memory.

A data comparison unit 145 compares the two frame data, thereby detecting an area having a change. The area having the change is stored into the memory 27 as an area in which data should be partially rewritten. Even by using such a construction, the display control method shown in FIG. 6 is effective as it is.

Although each of the above embodiments has been described with respect to the example in case of using the FLC panel in which one pixel consists of four bits (RGBW), the display control method of the invention can be also applied to a monochromatic FLC panel or the like in which one pixel consists of one bit or two bits or panels of other constructions by merely changing an output of the palette 43.

According to the display control apparatus of the embodiment as described above, since the area whose display content was changed is preferentially scanned, even when the frame frequency is low, the display content can be changed at a high speed.

When the partially rewriting area is large, the partially rewriting scan is executed by the interlace in which the number of scanning lines to be skipped is small. Therefore, the flickering due to the partially rewriting operation can be suppressed while keeping the display quality.

Therefore, according to the embodiment, even in case of using a display device of a low frame frequency, enough high response speed and display quality as a computer display can be realized.

Since the skip scan control for refreshing can be also executed by setting the flag in the memory for scanning area designation, a construction is simple and the invention is also effective to reduce the costs of the whole system.

The present invention is not limited to the foregoing embodiments but many modifications and variations are possible within the spirit and scope of the appended claims of the invention.

In other words, the foregoing description of the embodiments has been given for illustrative purposes only and not to be construed as imposing any limitation in every respect.

The scope of the invention is, therefore, to be determined solely by the following claims and not limited by the text of the specifications and alterations made within a scope equivalent to the scope of the claims falling within the true spirit and scope of the invention.

What is claimed is:

1. A display control apparatus comprising:

a) display means;

b) memory means for storing display data which is displayed on said display means;

c) detecting means for detecting an area in which the data has been updated in said memory means; and d) control means for performing a scan control of said display means in a manner such as to rewrite the data in a scanning area of said display means corresponding to the area detected by said detecting means by an m-field interlace scan and to rewrite the data in the scanning areas of said display means other than the area detected by said detecting means by an n-field interlace scan, wherein m and n are natural numbers, and wherein said control means changes the values of m and n in accordance with the area detected by said detecting means, and said control means includes a table storing the values of m and n corresponding to the area and sets the values of m and n on the basis of said table.

2. An apparatus according to claim 1, wherein said control means controls the values of n and m in accordance with a size of area detected by said detecting means.

3. An apparatus according to claim 1, further having scanning speed detecting means for detecting a scanning speed of said display means, and wherein said control means controls the values of n and m in accordance with an output of said scanning speed detecting means.

4. An apparatus according to claim 1, wherein said control means further has scan instructing memory means for storing line information to be scanned on said display means.

5. An apparatus according to claim 4, wherein said control means scans on the basis of the data stored in said scan instructing memory means.

6. An apparatus according to claim 1, wherein the value of said n is a multiple of the value of said m.

7. An apparatus according to claim 1, wherein said display means uses a ferroelectric liquid crystal.

8. A display control apparatus comprising:

a) display means;

b) detecting means for detecting a size of a partial rewriting area in which a display has been changed; and c) control means for performing a scan control of said display means in a manner such as to execute an m-field interlace scan (where, m: 0, 1, 2, 3 . . . ) to a scanning area portion of said display means corresponding to the partial rewriting area, wherein said control means changes the values of m in accordance with the partial rewriting area detected by said detecting means, and said control means includes a table storing the value of m corresponding to the partial rewriting area and sets the value of m on the basis of said table.

9. An apparatus according to claim 8, further having scanning speed detecting means for detecting a scanning speed of said display means, and wherein the value of said In is controlled on the basis of an output of said scanning speed detecting means.

10. An apparatus according to claim 8, wherein said control means further has scan instructing memory means for storing line data to be scanned on said display means.

11. An apparatus according to claim 10, wherein said control means scans on the basis of the data stored in said scan instructing memory means.

12. An apparatus according to claim 8, wherein said display means uses a ferroelectric liquid crystal.

13. An apparatus according to claim 8, wherein said control means performs the scan control so as to execute an n-field interlace scan (where, n: 0, 1, 2, 3 . . . ), for scanning areas on said display means other than the partial rewriting area, wherein the value of n is changed in accordance with a size of the partial rewriting area detected by said detecting means.

14. A display control apparatus comprising:

a) display means for displaying inputted display data;

b) scanning speed detecting means for detecting a scanning speed of said display means;

c) memory means for storing display data to be displayed on said display means;

d) detecting means for detecting an area in which the data has been updated in said memory means; and e) control means for changing a scanning operation of the area detected by said detecting means on the basis of an output of said scanning speed detecting means, wherein the scanning operation is m-field interlace scan and said control means changes the values of m in accordance with the area detected by said detecting means, and said control means includes a table of the value of m corresponding to the scanning speed and the area and sets the value of m on the basis of said table.

15. An apparatus according to claim 14, wherein said display means uses a ferroelectric liquid crystal.

16. An apparatus according to claim 14, wherein said control means controls the value of m in accordance with a size of the area detected by said detecting means.

17. An apparatus according to claim 16, wherein said control means performs a scan control to execute an n-field interlace scan even for the scanning areas on said display means other than the area detected by said detecting means (where, n: 0, 1, 2, 3 . . . ).

18. A display control method of a display apparatus whose display content can be partially rewritten, comprising the steps of:

detecting a size of area to be partially rewritten; and performing an m-field interlace scan according to the size of the partially rewriting area detected to a scanning area portion on said display apparatus corresponding to the partially rewriting area, wherein said performing step changes the value of m in accordance with the size of the detected partially rewriting area, and said performing step sets the value of m on the basis of a table storing the value of m corresponding to the size of the partially rewriting area.

19. A display control method of a display apparatus whose display content can be partially rewritten, comprising the steps of:

detecting an area to be partially rewritten;

detecting a temperature of a display element; and changing a scanning operation of the detected area on the basis of the detected temperature and the detected area to be partially rewritten, wherein the scanning operation is an m-field interlace scan and said changing step changes the value of m, and wherein said changing step sets the value of m on the basis of a table storing the value of m corresponding to the temperature of the display element and the area to be partially rewritten.

20. A display control method of a display apparatus using a display element having a memory performance, comprising the steps of:

storing display data which is displayed on said display apparatus;

detecting an area in which the display data stored has been updated;

rewriting the data in a scanning area on the display apparatus corresponding to the detected area by an m-field interlace scan and also rewriting the data in the scanning areas on said display apparatus other than the area detected by said detecting step by an n-field interlace scan; and controlling the values of m and n in accordance with the detected area, wherein m and n are natural numbers, wherein said controlling step sets the values m and n on the basis of a table storing the values of m and n corresponding to the area.

21. A display control apparatus comprising:

a) display means constructed by using a display element having a memory performance;

b) control means for performing a scan control of said display means; and c) detecting means for detecting a partial rewriting area in which a display has been changed, wherein said control means is arranged to perform scan control of said display means in a manner so as to execute an m-line skip scan for the partial rewriting area detected by said detecting means and an n-line skip scan for scanning areas on said display means other than the partial rewriting area, said control means being adapted to selectively perform different skip scans of different combinations of the values of m and n, wherein m and n denote the number of scanning lines to be skipped, said control means changing the values of m and n in accordance with the partial rewriting area detected by said detecting means, and said control means including a table storing the values of m and n corresponding to the partial rewriting area and setting the values of m and n on the basis of said table.

22. An apparatus according to claim 21 wherein the value of m is selected on the basis of a size of said partial rewriting area detected by said detecting means.

23. An apparatus according to claim 21 further comprising:

scanning speed detecting means for detecting a scanning speed of said display means, wherein m is selected on the basis of an output of said scanning speed detecting means.

24. An apparatus according to claim 21, further comprising:

scan instruction memory means for storing line data to be scanned on said display means.

25. An apparatus according to claim 24, wherein said control means is arranged to perform scan control on the basis of the data stored in said scan instruction memory means.

26. An apparatus according to claim 21 wherein said display means uses a ferroelectric liquid crystal as said display element.

27. An apparatus according to claim 21 wherein the value of n is a multiple of the value of m.

28. An apparatus according to claim 21, further comprising:

scanning speed detecting means for detecting a scanning speed of said display means wherein m and n are selected on the basis of an output of said scanning speed detecting means.

29. An apparatus according to claim 21 further comprising:

memory means for storing display data to be displayed on said display means, and area detecting means for detecting an area in which said display data has been updated in said memory means.

30. An apparatus according to claim 21, wherein the value of m is less than the value of n.

31. A display method of a display means using a display element having a memory performance, comprising the steps of:

a) detecting a partial rewriting area in which a display has been changed; and b) performing scan control so as to execute an m-line skip scan for the detected partial rewriting area and an n-line skip scan for scanning areas other than the partial rewriting area, wherein said control step is adapted to selectively perform different skip scans of different combinations of the values of m and n, wherein m and n denote the number of scanning lines to be skipped, and wherein said control step changes the values of m and n in accordance with the detected partial rewriting area, and said control step sets the values of m and n on the basis of a table storing the values of m and n corresponding to the partial rewriting area.

* * * * *